US011269282B2

(12) United States Patent
Ikari et al.

(10) Patent No.: US 11,269,282 B2
(45) Date of Patent: Mar. 8, 2022

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kenichi Ikari, Chiba (JP); Naoaki Ichihashi, Chiba (JP); Hironori Owaki, Chiba (JP); Yasuhiro Kawai, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/205,440

(22) Filed: Mar. 18, 2021

(65) Prior Publication Data

US 2021/0302908 A1 Sep. 30, 2021

(30) Foreign Application Priority Data

Mar. 26, 2020 (JP) ..... JP2020-056463

(51) Int. Cl.
*G03G 15/00* (2006.01)
*G03G 21/18* (2006.01)
(Continued)

(52) U.S. Cl.
CPC ..... *G03G 15/751* (2013.01); *G03G 15/75* (2013.01); *G03G 21/1671* (2013.01);
(Continued)

(58) Field of Classification Search
CPC .. G03G 15/75; G03G 15/751; G03G 21/1671; G03G 21/1814;
(Continued)

(56) References Cited

U.S. PATENT DOCUMENTS 6,636,715 B2 10/2003 Kawamura et al.
7,229,731 B2 6/2007 Aoki et al.
(Continued)

FOREIGN PATENT DOCUMENTS

JP 2013-210594 A 10/2013
JP 2016-85271 A 5/2016

OTHER PUBLICATIONS

U.S. Appl. No. 17/199,024, Naoaki Ichihashi, filed Mar. 11, 2021.

*Primary Examiner* — Joseph S Wong
(74) *Attorney, Agent, or Firm* — Venable LLP

(57) ABSTRACT

Disclosed is a cylindrical electrophotographic photosensitive member having a region A along an outer surface and a region B along the outer surface. In this electrophotographic photosensitive member, the region A is located on an end side in an axial direction of the electrophotographic photosensitive member relative to the region B, the region A has a specific groove provided on the outer surface of the electrophotographic photosensitive member, an area ratio a1 of the groove is 65% to 100%, the region B has specific concave portions provided on the outer surface of the electrophotographic photosensitive member, and an area ratio a2 of the concave portion is 5% to 65%.

8 Claims, 10 Drawing Sheets

(51) Int. Cl.
*G03G 21/16* (2006.01)
*G03G 8/00* (2006.01)
*G03G 5/147* (2006.01)

(52) U.S. Cl.
CPC ..... *G03G 21/1814* (2013.01); *G03G 5/14752* (2013.01); *G03G 5/14756* (2013.01); *G03G 8/00* (2013.01); *G03G 2221/0015* (2013.01)

(58) Field of Classification Search
CPC ..... G03G 2221/0015; G03G 5/14752; G03G 5/14756; G03G 8/00
See application file for complete search history.

(56) References Cited

U.S. PATENT DOCUMENTS 8,457,528 B2 6/2013 Ochi et al.
8,783,209 B2 7/2014 Kaku et al.
9,114,565 B2 8/2015 Kawai et al.
9,389,521 B2 7/2016 Takahashi et al.
9,766,561 B2 9/2017 Takahashi et al.
9,772,596 B2 9/2017 Mitsui et al.
9,817,324 B2 11/2017 Kitamura et al.
9,971,258 B2 5/2018 Kitamura et al.
10,042,273 B2 8/2018 Takahashi et al.
10,338,486 B2 7/2019 Abe et al.
10,359,729 B2 7/2019 Ichihashi et al.
10,642,175 B2 5/2020 Ohira et al.
10,895,840 B2 1/2021 Ichihashi et al.
2003/0003273 A1* 1/2003 Izutani ..... G03G 15/6588 428/168
2006/0194132 A1 8/2006 Hosoi et al.
2011/0076057 A1* 3/2011 Kami ..... G03G 5/14734 399/159
2014/0093281 A1 4/2014 Takahashi et al.
2018/0314188 A1* 11/2018 Takeuchi ..... G03G 5/144
2020/0341394 A1 10/2020 Ikari et al.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND

Field

The present disclosure relates to an electrophotographic photosensitive member, a process cartridge having the electrophotographic photosensitive member, and an electrophotographic apparatus having the electrophotographic photosensitive member.

Description of the Related Art

To a surface of the electrophotographic photosensitive member, an electrical external force and a mechanical external force in charging, cleaning and the like are applied, and therefore the electrophotographic photosensitive member surface is required to have a durability (anti-wearing property) against these external forces.

In order to meet this requirement, a resin having a high anti-wearing property such as a curable resin has been conventionally used in a surface layer of the electrophotographic photosensitive member.

On the other hand, if the anti-wearing property of the surface of the electrophotographic photosensitive member is increased, problems such as slip-through of toner due to squealing of a cleaning blade and image smearing occur. On the other hand, a method of suitably roughening the surface of the electrophotographic photosensitive member has been proposed.

As a technique for improving the slip-through of toner, for example, Japanese Patent Application Laid-Open No. 2016-85271 can be mentioned.

Examples of a technique for remedying the image smearing include Japanese Patent Application Laid-Open No. 2013-210594.

According to the study by the present inventors, although the electrophotographic photosensitive member described in Japanese Patent Application Laid-Open No. 2016-85271 has a very large effect of improving slip-through of toner, when the electrophotographic photosensitive member is used for a long period of time in a low humidity environment, an electrophotographic image may have a streak-like image defect (hereinafter also referred to as low-humidity durability streak).

Furthermore, according to the study by the present inventors, although the electrophotographic photosensitive member described in Japanese Patent Application Laid-Open No. 2013-210594 has a very large effect of improving image smearing, abnormal noise of a cleaning blade (hereinafter also referred to as blade squealing) may occur.

SUMMARY

Therefore, an object of the present disclosure is to provide an electrophotographic photosensitive member that can suppress both a low-humidity durability streak and blade squealing.

The above object is achieved by the following disclosure.

That is, an electrophotographic photosensitive member according to one aspect of the present disclosure is a cylindrical electrophotographic photosensitive member having a support and a surface layer, and has a region A along an outer surface of the surface layer and a region B along the outer surface of the surface layer. In this electrophotographic photosensitive member, the region A is located on an end side in an axial direction of the electrophotographic photosensitive member relative to the region B, has a groove provided on an outer surface of the electrophotographic photosensitive member, an average value d1 of a depth of the groove is 0.3 μm to 5.0 μm, a width of the groove in a circumferential direction of the electrophotographic photosensitive member is 500 μm or more, an average value W1 of the width of the groove in the axial direction of the electrophotographic photosensitive member is 2 μm to 50 μm, an area ratio a1 of the groove is 65% to 100%, the region B has concave portions provided on the outer surface of the electrophotographic photosensitive member, an average value d2 of a depth of the concave portion is 0.3 μm to 1.5 μm, an average value L1 of a width of the concave portion in the circumferential direction of the electrophotographic photosensitive member is 20 μm to 200 μm, an average value W2 of the width of the concave portion in the axial direction of the electrophotographic photosensitive member is the L1 or less, an area ratio a2 of the concave portion is 5% to 65%, and the area ratio a1 of the groove is larger than the area ratio a2 of the concave portion.

Further, a process cartridge according to another aspect of the present disclosure integrally supports the electrophotographic photosensitive member and at least one unit selected from the group consisting of a charging unit, a developing unit, and a cleaning unit, and is detachably attachable to a main body of an electrophotographic apparatus.

Furthermore, an electrophotographic apparatus according to still another aspect of the present disclosure includes the electrophotographic photosensitive member, a charging unit, an exposing unit, a developing unit, a transfer unit, and a cleaning unit. In this electrophotographic apparatus, in an axial direction of the electrophotographic photosensitive member, an end of an image-formable region of the electrophotographic photosensitive member is within a range of the region B.

Further features of the present disclosure will become apparent from the following description of exemplary embodiments with reference to the attached drawings.

DESCRIPTION OF THE EMBODIMENTS

Figure 1:
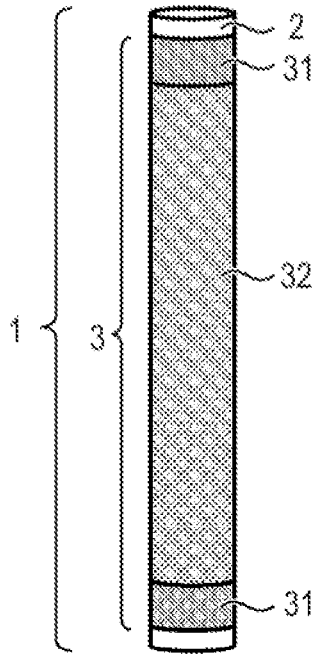
FIG. 1 is a diagram showing an appearance of an example of an electrophotographic photosensitive member according to the present disclosure.

An electrophotographic photosensitive member according to the present disclosure is a cylindrical electrophotographic photosensitive member having a support and a surface layer, and has a region A along an outer surface of the surface layer and a region B along the outer surface of the surface layer. In this electrophotographic photosensitive member, the region A is located on an end side in an axial direction of the electrophotographic photosensitive member relative to the region B, the region A has a groove provided on the outer surface of the electrophotographic photosensitive member, an average value d1 of a depth of the groove is 0.3 μm to 5.0 μm, a width of the groove in a circumferential direction of the electrophotographic photosensitive member is 500 μm or more, an average value W1 of the width of the groove in the axial direction of the electrophotographic photosensitive member is 2 μm to 50 μm, an area ratio a1 of the groove is 65% to 100%, the region B has concave portions provided on the outer surface of the electrophotographic photosensitive member, an average value d2 of a depth of the concave portion is 0.3 μm to 1.5 μm, an average value L1 of a width of the concave portion in the circumferential direction of the electrophotographic photosensitive member is 20 μm to 200 μm, an average value W2 of the width of the concave portion in the axial direction of the electrophotographic photosensitive member is the L1 or less, an area ratio a2 of the concave portion is 5% to 65%, and the area ratio a1 of the groove is larger than the area ratio a2 of the concave portion.

The area of the groove or the area of the concave portion means an area in a surface of the electrophotographic photosensitive member of a region surrounded by a line in which a depressed portion is in contact with a flat portion around the depressed portion when viewed from directly above a circumferential surface of the electrophotographic photosensitive member looking down the groove or the concave portion. Details of determining the area of the groove or the area of the concave portion will be described later.

In the present disclosure, a direction parallel to the axis of the cylindrical electrophotographic photosensitive member is defined as the axial direction of the electrophotographic photosensitive member. A direction extending perpendicular to the axial direction of the electrophotographic photosensitive member and along the circumferential surface of the electrophotographic photosensitive member is defined as the circumferential direction of the electrophotographic photosensitive member.

The main differences between the electrophotographic photosensitive member according to the present disclosure and a conventionally known electrophotographic photosensitive member having a groove or a concave portion on its surface will be described.

In the conventionally known electrophotographic photosensitive member having the groove or the concave portion on its surface, a uniform shape in the axial direction of the electrophotographic photosensitive member is provided over the entire circumferential surface of the electrophotographic photosensitive member. In such conventional electrophotographic photosensitive members, all proportions of the groove or concave portion on the surface of the electrophotographic photosensitive member are uniform, especially in a range in contact with a cleaning blade.

On the other hand, in the electrophotographic photosensitive member according to the present disclosure, the region A located on the end side of the surface layer in the axial direction of the electrophotographic photosensitive member has a groove, and the region B located on a center side of the surface layer in the axial direction of the electrophotographic photosensitive member relative to the region A has a concave portion. The average value d1 of the depth of the groove is 0.3 μm to 5.0 μm, the groove width in the circumferential direction of the electrophotographic photosensitive member is 500 μm or more, and the average value W1 of the width of the groove in the axial direction of the electrophotographic photosensitive member is 2 μm to 50 μm. The average value d2 of the depth of the concave portion is 0.3 μm to 1.5 μm, the average value L1 of the width of the concave portion in the circumferential direction of the electrophotographic photosensitive member is 20 μm to 200 μm, and the average value W2 of the width of the concave portion in the axial direction of the electrophotographic photosensitive member is L1 or less. While the area ratio a1 of the groove of the region A is 65% to 100%, the area ratio a2 of the concave portion of the region B is 5% to 65%.

As a result of the study by the present inventors, it has been found that when the groove and the concave portion having different shapes are arranged on the surface of the electrophotographic photosensitive member with respect to the axial direction of the electrophotographic photosensitive member as described above, a low-humidity durability streak and blade squealing are suppressed.

The reasons for suppressing the low-humidity durability streak and the blade squealing by using the electrophotographic photosensitive member according to the present disclosure are not yet completely clarified, but are presumed as follows.

The surface layer of the electrophotographic photosensitive member has a region where the presence or absence of a member abutted against and facing the surface layer is different at the end in the axial direction of the electrophotographic photosensitive member. That is, a charging roller, a developing roller, an intermediate transfer belt, and the cleaning blade have different lengths with respect to the axial direction of the electrophotographic photosensitive member, so that a range abutted against and facing the surface of the surface layer of the electrophotographic photosensitive member is different therebetween. As a result, on the surface of the surface layer, there are a region where deterioration due to charging progresses and a region where the deterioration does not progress depending on the presence or absence of the charging roller. In addition, there are a region where polishing using toner or an external additive occurs and a region where the polishing does not occur depending on the presence or absence of the developing roller. Due to a combination thereof, while discharge deterioration of the charged electrophotographic photosensitive member progresses, there is the region where the polishing using toner or an external additive does not occur due to out of the development range, and the progress of deterioration is remarkable in this region. That is, when the surface of the surface layer is viewed in the axial direction of the electrophotographic photosensitive member, the progress of the deterioration and wear of the surface due to repeated printing processes is not uniform. As a result, after repeated use, stress applied to the cleaning blade becomes non-uniform in the axial direction of the electrophotographic photosensitive member.

On the other hand, in the electrophotographic photosensitive member according to the present disclosure, the area ratio a1 of the groove of the region A located on the end side of the surface layer in the axial direction of the electrophotographic photosensitive member is 65% to 100%. On the other hand, the area ratio a2 of the concave portion of the region B located on the center side of the surface layer in the axial direction of the electrophotographic photosensitive member is 5% to 65%. In addition, the area ratio a1 of the groove is larger than the area ratio a2 of the concave portion. In other words, the surface on the end side of the surface layer in the axial direction of the electrophotographic photosensitive member has less flat portions than the surface on a central side of the surface layer in the axial direction of the electrophotographic photosensitive member. From this, it is considered that a contact area between the cleaning blade and the electrophotographic photosensitive member is reduced on the end side of the surface layer in the axial direction of the electrophotographic photosensitive member, and a frictional force is more effectively reduced.

Furthermore, it is considered that the concave portion of the region B changes an abutment state between the cleaning blade and the electrophotographic photosensitive member by forming a suitable concavoconvex shape to reduce the frictional force.

Based on the above, the present inventors consider that the electrophotographic photosensitive member according to the present disclosure suppresses non-uniformity of stress applied to the cleaning blade and suppresses blade squealing.

An image-formable region is located close to the center in the axial direction of the electrophotographic photosensitive member, and in this region, there are all members abutted against and facing the electrophotographic photosensitive member. That is, the above-mentioned region where the progress of deterioration is remarkable is outside the image-formable region. Thus, it is preferable that the region A be disposed outside the image-formable region.

In the electrophotographic photosensitive member according to the present disclosure, in region B, when the electrophotographic photosensitive member is rotated to bring the cleaning blade into contact with the electrophotographic photosensitive member, the flat end and concave portion of the surface of the electrophotographic photosensitive member and the cleaning blade come into contact with each other in response to rotation of the electrophotographic photosensitive member in the circumferential direction. That is, such a continuous change in frictional force occurs that in response to the rotation of the electrophotographic photosensitive member in the circumferential direction, a strong frictional force is generated when the flat end and the cleaning blade come into contact with each other, and the frictional force is reduced when the concave portion and the cleaning blade come into contact with each other. Due to this change in frictional force, a part of the stress accumulated in the cleaning blade is released, and the stress accumulation is alleviated. It is considered that when the accumulation of stress on the cleaning blade is alleviated, the deformation and wear of the cleaning blade and the accompanying vibration of the cleaning blade can be suppressed. Thus, the present inventors consider that the low-humidity durability streak is suppressed by stabilizing a rubbing state of the electrophotographic photosensitive member and making a rubbing history of the surface of the electrophotographic photosensitive member uniform.

The electrophotographic photosensitive member according to the present disclosure will be described in more detail with reference to the drawings.

FIG. 1 is a diagram showing an appearance of an example of the electrophotographic photosensitive member according to the present disclosure. As shown in FIG. 1, a cylindrical electrophotographic photosensitive member 1 has a cylindrical substrate 2 and a surface layer 3 provided on an outer surface side of the cylindrical substrate 2. A groove and a concave portion are provided on an outer surface of the surface layer 3.

The electrophotographic photosensitive member 1 has a region A31 along the outer surface and a region B32 along the outer surface, and the region A31 is located on an end side in an axial direction of the electrophotographic photosensitive member 1 relative to the region B32.

A combined region of the region A31 and the region B32 may be provided in the same range as the surface layer 3 in the axial direction of the electrophotographic photosensitive member 1, or may be provided in a range corresponding to approximately a length where the cleaning blade is in contact even if the length is shorter than the range of the surface layer 3.

The region A31 has a groove provided on the outer surface of the surface layer 3. The region B32 has concave portions provided on the outer surface of the surface layer 3.

The shapes of the groove and concave portion on the outer surface of the surface layer can be observed using a microscope such as a laser microscope, an optical microscope, an electron microscope or an atomic force microscope.

For the laser microscope, for example, the following instruments can be utilized:

super-depth shape measuring microscope VK-8550, super-depth shape measuring microscope VK-9000, and super-depth shape measuring microscopes VK-9500, VK-X200, and VK-X100 (all manufactured by Keyence Corporation); scanning confocal laser microscope OLS3000 (manufactured by Olympus Corporation); and real color confocal microscope Oplitecs C130 (manufactured by Lasertec Corporation).

For the optical microscope, for example, the following instruments can be utilized:

digital microscope VHX-500 and digital microscope VHX-200 (manufactured by Keyence Corporation); and 3D digital microscope VC-7700 (manufactured by OMRON Corporation).

For the electron microscope, for example, the following instruments can be utilized:

3D real surface view microscope VE-9800 and 3D real surface view microscope VE-8800 (manufactured by Keyence Corporation); scanning electron microscope Conventional/Variable Pressure SEM (manufactured by Hitachi High-Tech Science Corporation) (former: SII Nanotechnology Inc.); and scanning electron microscope SUPERSCAN SS-550 (manufactured by Shimadzu Corporation).

For the atomic force microscope, for example, the following instruments can be utilized:

nano-scale hybrid microscope VN-8000 (manufactured by Keyence Corp.); scanning probe microscope Nano Navi Station (manufactured by Hitachi High-Tech Science Corporation); and scanning probe microscope SPM-9600 (manufactured by Shimadzu Corporation).

Determination (definition) of the concave portion, groove, flat portion, etc. on the outer surface of the surface layer will be described.

Figure 2:
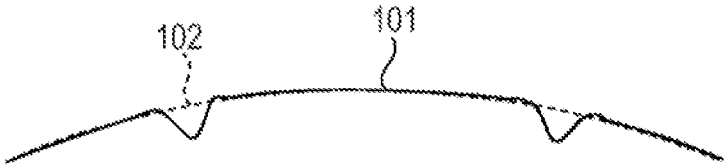
FIG. 2 is a diagram showing an example of fitting of a concave portion on a surface of the electrophotographic photosensitive member according to the present disclosure.
Figure 3A:
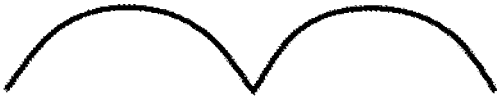
FIGS. 3A, 3B, 3C and 3D are diagrams showing an example of a cross-sectional shape of a groove on a surface of the electrophotographic photosensitive member according to the present disclosure.
Figure 3B:
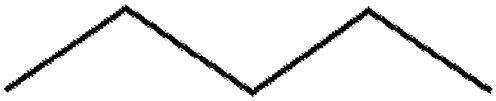
Figure 3C:
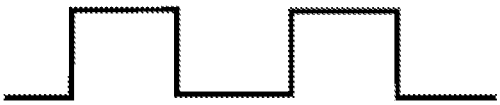
Figure 3D:
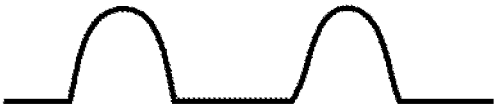

First, a circumferential surface of the electrophotographic photosensitive member is magnified and observed with a microscope. Since the circumferential surface of the electrophotographic photosensitive member is a curved surface curved in the circumferential direction, a cross-sectional profile of the curved surface is extracted, and a curve (arc) is fitted. FIG. 2 shows an example of fitting. In FIG. 2, a solid line 101 is the cross-sectional profile of the circumferential surface (curved surface) of the electrophotographic photosensitive member, and a broken line 102 is a curve obtained by fitting a curve (arc) to the cross-sectional profile 101. The cross-sectional profile 101 is corrected so that the curve 102 becomes a straight line, and a plane obtained by extending the obtained straight line in the axial direction of the electrophotographic photosensitive member is used as a reference plane.

A portion located below the obtained reference plane is defined as a concave portion or groove. A distance from the reference plane to a lowest point of the concave portion or groove is defined as a depth of the concave portion or groove. A cross section of the concave portion or groove according to the reference plane is defined as an opening, and a length of a longest line segment that crosses the opening in the axial direction is defined as the width in the axial direction of the concave portion or groove. Similarly, a length of a longest line segment that crosses the opening in the circumferential direction is defined as the width in the circumferential direction of the concave portion or groove An average value of the width and an average value of the depth of each of the concave portion and the groove can be calculated as follows First, the outer surface of the surface layer of the electrophotographic photosensitive member to be measured is divided into four equal parts in the circumferential direction of the electrophotographic photosensitive member. In addition, a square region having a side of 500 μm is provided in each of a total of 200 regions obtained by dividing the outer surface of the surface layer into 50 equal parts in the axial direction, and each region is observed. The region A and the region B are specified from the shapes of the concave portion and the groove obtained in the 200 square regions. Then, from an observation result of the groove in the region A, the width and depth of all the grooves included in the square region having a side of 500 μm are measured, and then divided by the number of grooves to calculate a number average value the width and depth of the groove. From an observation result of the concave portion in the region B, the width and depth of all the concave portions included in the square region having a side of 500 μm are measured, and then divided by the number of concave portions to calculate a number average value the width and depth of the concave portion.

The area ratio of the concave portion and the groove is calculated as follows. The region A and the region B are specified by the above method, and an area of the opening of the concave portion or the groove included in the square region having a side of 500 μm is measured. From an observation result of the groove in the region A, the area ratio of the groove is calculated by diving a total of the area of the opening of the groove by a total area of an observation region. From an observation result of the concave portion in the region B, the area ratio of the concave portion is calculated by diving a total of the area of the opening of the concave portion by the total area of the observation region.

The groove of the region A will be further described.

The groove preferably has a shape that intersects and extends in the axial direction of the electrophotographic photosensitive member. The groove having the shape that intersects and extends in the axial direction of the electrophotographic photosensitive member may be a single spiral groove or may be composed of grooves. Particularly, it is preferable that the region A have grooves, and the grooves be arranged independently of each other in the axial direction of the electrophotographic photosensitive member. In particular, it is preferable that the grooves be arranged in the axial direction of the electrophotographic photosensitive member and arranged in parallel with each other. As a result, an effect of reducing friction between the electrophotographic photosensitive member and the cleaning blade becomes higher, and it becomes possible to effectively suppress blade squealing.

A groove shape provided on the outer surface of the surface layer is not particularly limited as long as the average value of the depth, the average value of the width in the circumferential direction, and the average value of the width in the axial direction are within the respective ranges described above. In particular, the width of the groove in the axial direction of the electrophotographic photosensitive member is preferably in a range of 1.9 μm to 55 μm. The depth of the groove is preferably in a range of 0.2 μm to 5.5 μm.

Examples of a cross-sectional shape of the groove in a direction intersecting the axial direction are shown in FIGS. 3A to 3D. Examples of the cross-sectional shape of the groove include curved shapes such as a substantially semicircular shape, wavy shapes each composed of a continuous curve, shapes having edges such as a triangle, a quadrangle and a polygon, and shapes in which part or all of the edges of the triangle, quadrangle or polygon has been transformed into a curve or curves.

The groove provided in the region A additionally may have different shapes, opening areas, and depths which are slightly present in a mixed state.

Next, the concave portion of the region B will be further described.

A concave portions shape provided in the region B is not particularly limited as long as the average value of the depth and the average value of the width are within the respective ranges described above. The depth of the concave portion is preferably in a range of 0.2 μm to 1.7 μm. The width in the circumferential direction of the concave portion is preferably in a range of 18 μm to 220 μm.

Figure 4A:
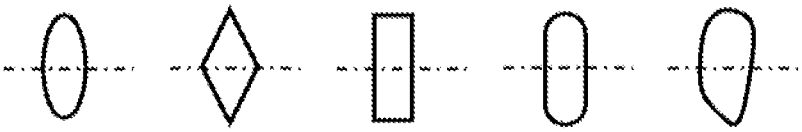
FIGS. 4A and 4B are diagrams showing an example of a shape and a cross-sectional shape of an opening of the concave portion on the surface of the electrophotographic photosensitive member according to the present disclosure.
Figure 4B:
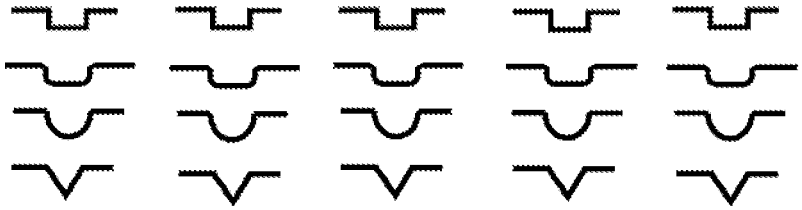

The concave portion has an opening that is a virtual plane formed when the concave portion is flush. FIG. 4A shows an example of the shape of the opening of the concave portion. Examples of the shape of the opening of the concave portion include a circle, an ellipse, a square, a rectangle, a triangle, a pentagon, and a hexagon. An example of a cross-sectional shape of the concave portion is shown in FIG. 4B. Examples of the cross-sectional shape of the concave portion include curved shapes such as a substantially semicircular shape, wavy shapes each composed of a continuous curve, shapes having edges such as a triangle, a quadrangle and a polygon, and shapes in which part or all of the edges of the triangle, quadrangle or polygon has been transformed into a curve or curves.

It is more preferable that the concave portion of the region B have a specific shape as described below. That is, a contour of the opening of the concave portion has a top on the upstream side in a rotational direction of the electrophotographic photosensitive member, and an angle α of the top is more than 0° and 90° or less. The contour of the opening of the concave portion is reduced from a portion in which a width of the contour of the opening of the concave portion in the axial direction of the electrophotographic photosensitive member is maximum to the top, and in the cross section of the concave portion perpendicular to the axial direction of the electrophotographic photosensitive member and including the top, the concave portion becomes shallow from a deepest point of the concave portion in the cross section to the top.

Figure 5A:
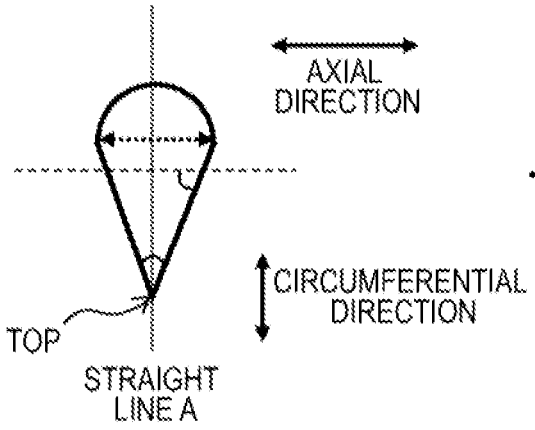
FIG. 5A is a diagram showing the shape of the opening in an example of the concave portion on the surface of the electrophotographic photosensitive member according to the present disclosure.
Figure 5B:
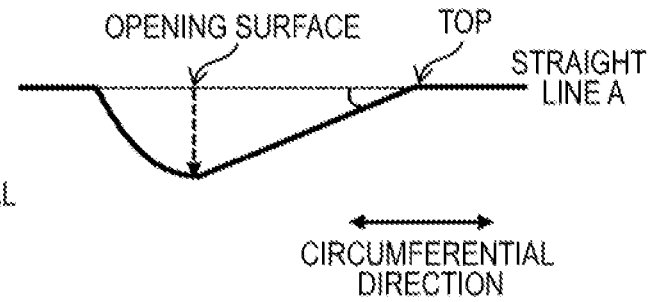
FIG. 5B is a diagram showing a cross-sectional shape in an example of the concave portion on the surface of the electrophotographic photosensitive member according to the present disclosure.
Figure 6A:
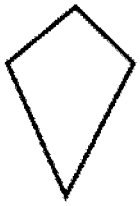
FIGS. 6A, 6B, 6C, 6D, 6E, 6F, 6G, 6H, 6I and 6J are diagrams showing an example of the shape of the opening of the concave portion on the surface of the electrophotographic photosensitive member.
Figure 6B:
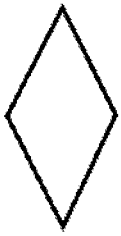
Figure 6C:
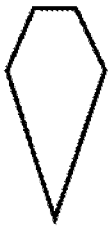
Figure 6D:
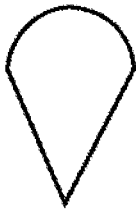
Figure 6E:
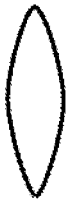
Figure 6F:
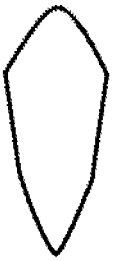
Figure 6G:
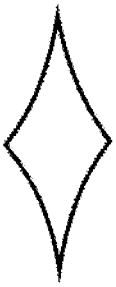
Figure 6H:
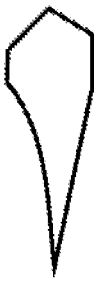
Figure 6I:
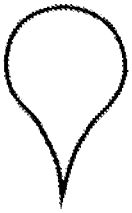
Figure 6J:
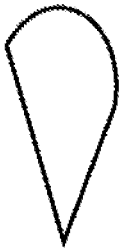
Figure 7A:
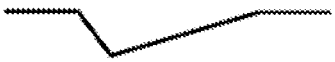
FIGS. 7A, 7B, 7C, 7D, 7E, 7F, 7G and 7H are diagrams showing an example of a shape of a cross-sectional portion when viewed from a circumferential direction of the concave portions on the surface of the electrophotographic photosensitive member.
Figure 7B:
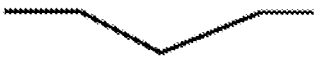
Figure 7C:
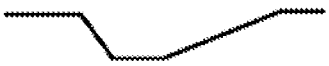
Figure 7D:
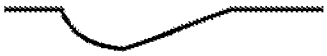
Figure 7E:
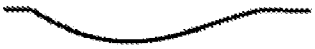
Figure 7F:
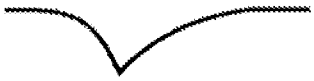
Figure 7G:
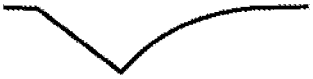
Figure 7H:
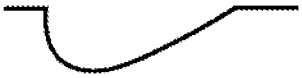

FIGS. 5A and 5B show an example of the concave portion having the above specific shape. The opening of the concave portion shown in FIG. 5A has a top (intersection) formed by two straight lines in one of the circumferential directions of the electrophotographic photosensitive member, and the other has a semicircular shape. In the contour of the opening, a distance to a straight line A decreases from two points (position indicated by a dotted line of an arrow from the straight line A) where the distance to the straight line A parallel to the circumferential direction passing through the top (intersection) is the longest to the top (intersection).

In the concave portion having the specific shape described above, a straight line (two straight lines in total) connecting each point in the portion in which the width of the contour of the opening of the concave portion in the axial direction of the electrophotographic photosensitive member is maximum and the top will be considered. At this time, an angle formed by each of the two straight lines to be obtained and a straight line parallel to the axial direction of the electrophotographic photosensitive member is preferably 45° to 90°. In addition, the angle is more preferably 62° or more and less than 90°.

In the present disclosure, when the line forming the contour of the opening of the concave portion is a curved line, the angle α of the top is defined as follows. That is, with respect to the curve constituting the contour of the opening, an angle formed by two straight lines connecting the top and two points on a curve where a distance from the top in the circumferential direction of the electrophotographic photosensitive member is 5 μm is defined as the angle α of the top. The angle α of the top is preferably more than 0° and an angle of 58° or less. The angle α is more preferably 56° or less.

Next, a cross section of the concave portion having the specific shape described above, which is parallel to the circumferential direction, will be described with reference to FIG. 5B.

The cross section parallel to the circumferential direction of the concave portion shown in FIG. 5B indicates that it becomes linearly shallow from a deepest point from an opening surface of the concave portion to the top. A contour of the cross section in a direction opposite to a direction from the deepest point from the opening surface of the concave portion toward the top is dome-shaped. In the present disclosure, in the concave portion having the specific shape described above, an angle formed by the straight line connecting the deepest point from the opening surface of the concave portion and the opening surface of the concave portion is preferably 8.5° or less. The angle is more preferably 3.8° or less.

Examples of the shape of the opening of the concave portion having the specific shape described above include the shapes shown in FIGS. 6A to 6J. Examples of the shape of the cross section parallel to the circumferential direction of the concave portion having the specific shape described above include the shapes as shown in FIGS. 7A to 7H.

From the viewpoint of more stabilizing the behavior of the cleaning blade, it is preferable that the concave portions having a specific shape be arranged as follows. That is, it is preferable that the concave portions be aligned so that the central axis is the same in the circumferential direction of the electrophotographic photosensitive member, and the concave portions adjacent to each other in the axial direction be arranged to be displaced by a distance shorter than a length in the circumferential direction of the concave portion.

In addition, the concave portions of the region B which have different shapes, opening areas, and depths may be slightly present in a mixed state.

The average value W2 of the width of the concave portion in the axial direction of the electrophotographic photosensitive member is preferably equal to or more than the average value W1 of the width of the groove in the axial direction of the electrophotographic photosensitive member from the viewpoint of suppressing blade squealing. It is considered that since the width of the groove is smaller than the width of the concave portion in the axial direction of the electrophotographic photosensitive member, the action of reducing the frictional force by the groove can be more effectively exhibited in an end region where a developer is small and the frictional force increases, and blade squealing can be effectively suppressed.

It is preferable that the average value d1 of the depth of the groove is equal to or more than the average value d2 of the depth of the concave portion from the viewpoint of suppressing blade squealing. It is considered that since the groove is deeper than the concave portion, the action of reducing the frictional force by the groove can be more effectively exhibited in the end region where a developer is small and the frictional force increases, and blade squealing can be effectively suppressed.

In the electrophotographic photosensitive member according to the present disclosure, the region A is located on the end side in the axial direction of the electrophotographic photosensitive member relative to the region B. Although the region A may be present only at one end of the surface layer in the axial direction of the electrophotographic photosensitive member, it is preferable that the regions A be present at both ends of the surface layer in the axial direction of the electrophotographic photosensitive member.

Specifically, the region A is preferably located at the following position. That is, when the length of the surface layer in the axial direction of the electrophotographic photosensitive member is 1, and the position in the axial direction of the electrophotographic photosensitive member is expressed by a value of 0 to 1, the region A is preferably within at least one of a range of 0 to 0.08 and a range of 0.92 to 1. The region A may be within only part of this numerical range, and is more preferably within the entire range.

Examples of a method of forming the concave portion and the groove on the surface of the electrophotographic photosensitive member include a method of pressing a mold member (mold) having a convex portion corresponding to the concave portion and groove to be formed against the surface of the electrophotographic photosensitive member and transferring the shape.

Figure 8A:
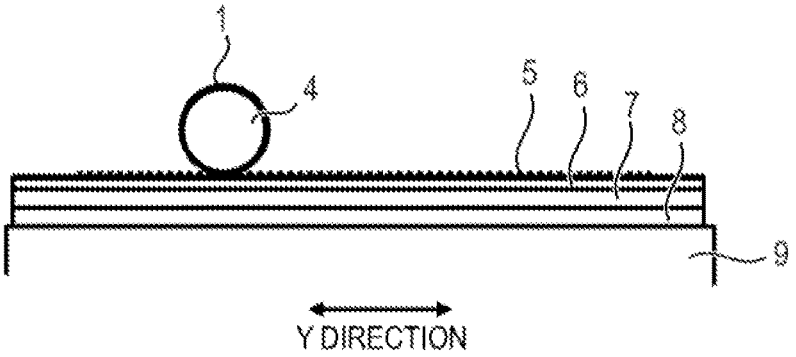
FIGS. 8A, 8B, 8C and 8D are diagrams showing an example of a method of forming the concave portion on the surface of the electrophotographic photosensitive member according to the present disclosure.
Figure 8B:
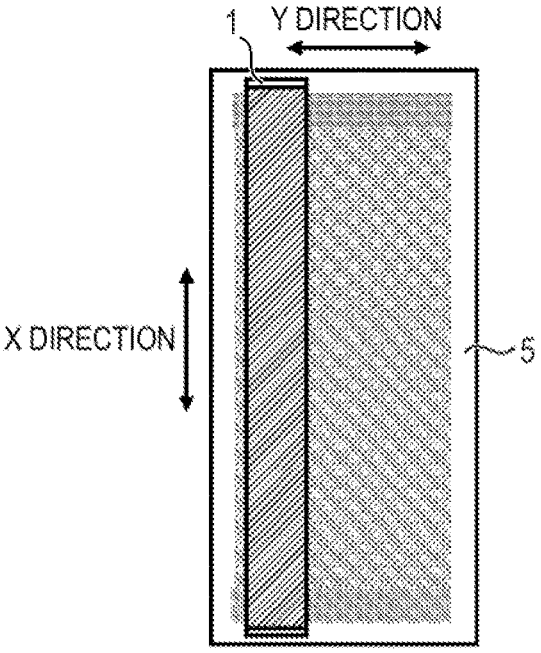
Figure 8C:
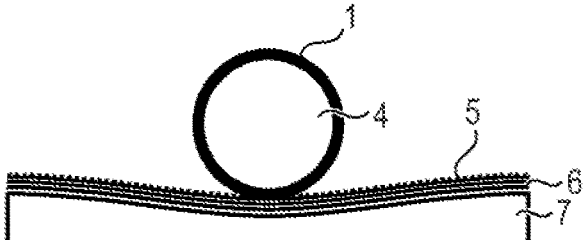
Figure 8D:
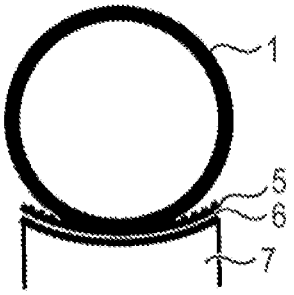

FIGS. 8A to 8D show an example of a pressure contact profile transfer processing apparatus for forming a concave portion on the surface of the electrophotographic photosensitive member. FIGS. 8A, 8C and 8D are side views showing an outline of the pressure contact profile transfer processing apparatus, and FIG. 8B is a top view showing the outline of the pressure contact profile transfer processing apparatus.

Figure 9A:
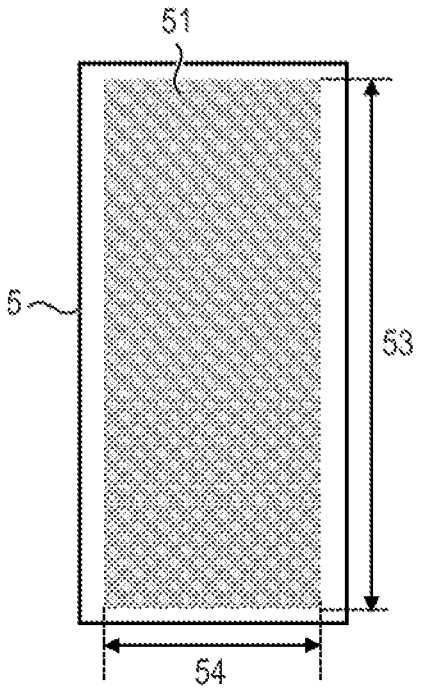
FIGS. 9A and 9B are diagrams showing an example of a mold member for forming a concave-shaped portion or a convex-shaped portion on the surface of the electrophotographic photosensitive member according to the present disclosure.
Figure 9B:
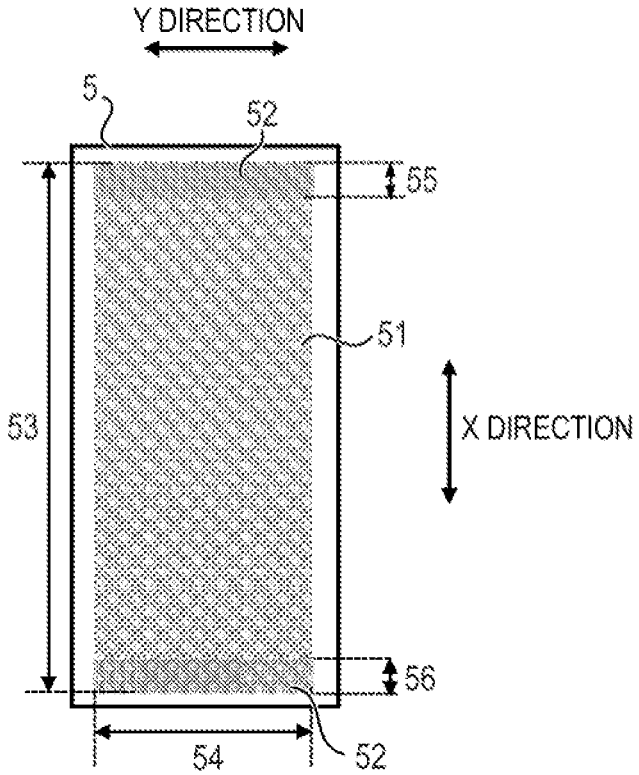

FIGS. 9A and 9B show an example of the mold member for forming a concave portion or a groove on the surface of the electrophotographic photosensitive member. FIGS. 9A and 9B are top views showing an outline of the mold member for forming a concave portion or a groove.

In each of the pressure contact profile transfer processing apparatus shown in FIGS. 8A to 8D and the mold member shown in FIGS. 9A and 9B, among directions along a surface provided with a convex shape of the mold member, a direction corresponding to the axial direction of the electrophotographic photosensitive member is an X direction, and a direction perpendicular to the X direction is a Y direction.

In the pressure contact profile transfer processing apparatus shown in FIGS. 8A to 8D, a mold member 5, a metal member 6, an elastic member 7, and a positioning member 8 are arranged on a support member 9 in order from the member closest to the electrophotographic photosensitive member 1 to be transferred. Using such a pressure contact profile transfer processing apparatus, an insertion member 4 is inserted into the electrophotographic photosensitive member 1, a load is applied to the insertion member 4, and the mold member 5 is moved in the Y direction shown in FIG. 8A by a slide mechanism or the like. In this way, while the electrophotographic photosensitive member 1 is rotated, the mold member 5 is continuously pressure-contacted with the surface (outer circumferential surface) thereof, whereby a concave portion can be formed on the surface of the electrophotographic photosensitive member 1. From the viewpoint of efficient shape transfer, it is preferable to heat the mold member 5 and the electrophotographic photosensitive member 1.

FIGS. 9A and 9B show the mold member 5 in which a flat plate is provided with a convex-shaped portion for forming a concave portion or a groove on the surface of the electrophotographic photosensitive member. The mold member 5 of FIG. 9A has a first convex-shaped portion 51 in which convex-shaped portions are provided over the entire surface. The mold member 5 of FIG. 9B has the first convex-shaped portion 51 provided with the convex-shaped portions. The mold member 5 of FIG. 9B has a second convex-shaped portion 52. The second convex-shaped portion 52 has a convex-shaped portion having a shape different from the convex-shaped portion provided in the first convex-shaped portion 51, and the convex-shaped portion of the second convex-shaped portion 52 has a groove shape along the Y direction.

Figure 10A:
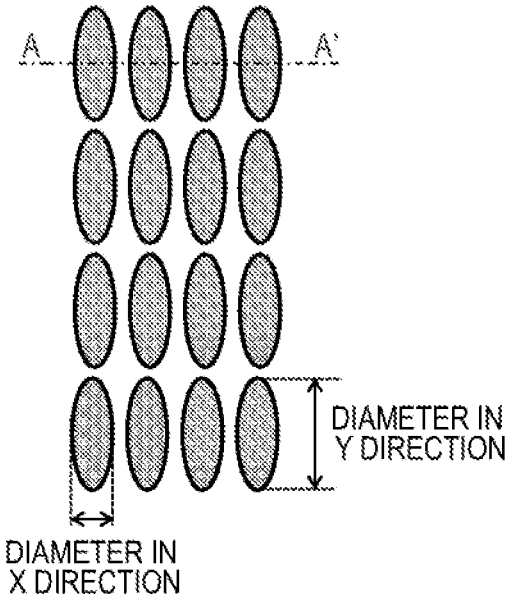
FIG. 10A is a schematic top view showing an example of a surface shape of the mold member.
Figure 10B:
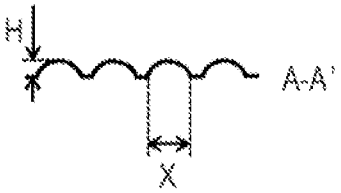
FIG. 10B is a schematic cross-sectional view of the mold member at a position A-A' in FIG. 10A, showing an example of the surface shape of the mold member.

FIGS. 10A and 10B show an outline of the convex-shaped portion provided in the first convex-shaped portion 51 of the mold member 5 shown in FIGS. 9A and 9B. FIG. 10A is a top view, and FIG. 10B is a cross-sectional view taken along line A-A' of FIG. 10A.

In the convex-shaped portion provided in the first convex-shaped portion 51, the shape observed from a direction perpendicular to a surface provided with the convex-shaped portion of the mold member may include various shapes. Examples of the shape include a circle/ellipse, a polygon such as a triangle/quadrangle/hexagon, and a shape in which a curve is mixed with part or all of the edges or sides of the polygon. Also in the cross-sectional shape of the convex-shaped portion, it is possible to form various shapes such as shapes having edges such as a triangle, a quadrangle and a polygon, wavy shapes each composed of a continuous curve, and shapes in which a curve is mixed with part or all of the edges of the triangle, quadrangle or polygon.

Figure 11A:
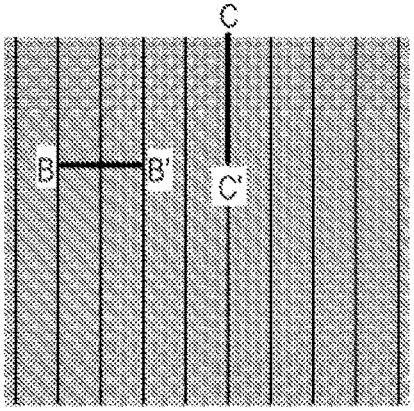
FIG. 11A is a schematic top view showing an example of the surface shape of the mold member.
Figure 11B:
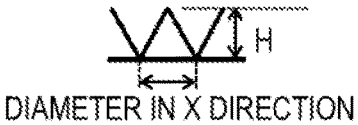
FIG. 11B is a schematic cross-sectional view of the mold member at a position B-B' in FIG. 11A, showing an example of the surface shape of the mold member.
Figure 11C:
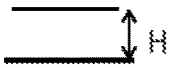
FIG. 11C is a schematic cross-sectional view of the mold member at a position C-C' in FIG. 11A, showing an example of the surface shape of the mold member.

FIGS. 11A to 11C show an outline of the convex-shaped portion provided in the second convex-shaped portion 52 of the mold member 5 shown in FIG. 9B. FIG. 11A is a top view of the mold member 5, FIG. 11B is a cross-sectional view of the convex-shaped portion on B-B' line in FIG. 11A, and FIG. 11C is a cross-sectional view of convex-shaped portion on C-C' line in FIG. 11A. The cross-sectional shape of the convex-shaped portion provided in the second convex-shaped portion 52 as shown in FIG. 11B may include various shapes. For example, it is possible to form various shapes such as shapes having edges such as a triangle, a quadrangle and a polygon, wavy shapes each composed of a continuous curve, and shapes in which a curve is mixed with part or all of the edges of the triangle, quadrangle or polygon.

Examples of the mold member 5 include metal and a resin film which are subjected to minute surface processing, one in which a surface of the silicon wafer is subjected to patterning with a resist, a resin film in which fine particles are dispersed, and one in which a resin film having a minute surface shape is subjected to metal coating. In particular, it is preferable to use metal represented by nickel, stainless steel, iron, and the like as a material, and it is preferable to reduce the thickness in the production from the viewpoint of production cost.

A main role of the metal member 6 is to produce a thin mold member and use this mold member, and to reinforce and support the mold member 5 when receiving a load force from the electrophotographic photosensitive member 1. From the viewpoint of durability, the metal member 6 is preferably made of metal, and in particular, spring steel or the like whose main raw material is an alloy such as iron, stainless steel, or copper is preferably used.

For the elastic member 7, it is preferable to use various rubber materials or materials having excellent flexibility such as sponge, and for example when heat is applied during processing, it is also effective to use a rubber material dispersed with metal particles for the purpose of ensuring heat transference.

It is important to reduce a rolling load of the electrophotographic photosensitive member 1 when the insertion member 4 and an apparatus body are fixed, and it is preferable to maintain a state where the insertion member 4 is rotatable around the axis by using a bearing or the like.

Next, a case where the metal member 6 is made of a single piece and a case where the metal member 6 is made of pieces will be described. In the case where the metal member 6 is made of a single piece, when the thickness of the metal member 6 is further increased to suppress deformation in order to secure a processing surface pressure, elongation of the member due to the thickness becomes longer, so that the number of times the metal member 6 can be used decreases. On the other hand, in the case where the metal member 6 is made of pieces, even if the number of pieces is increased to increase the total thickness and thus to suppress deformation in order to secure the processing surface pressure, the thickness of each piece can be set thin, so that the number of times the metal member 6 can be used can be increased.

That is, in the pressure contact profile transfer processing apparatus, it is preferable to use the metal members 6 which are stacked on a back surface side of a surface having a concavoconvex shape of the mold member 5 along a direction of pressurization, and are arranged so as to be able to be displaced from each other during pressurization. Furthermore, it is preferable to use the pressure contact profile transfer processing apparatus and the support member 9 that supports the metal members 6 so that the metal members 6 can be deflected in the pressurization direction.

Subsequently, in the axial direction of the electrophotographic photosensitive member 1, a range in which the concavoconvex shape of the surface of the mold member 5 is transferred to the surface of the electrophotographic photosensitive member 1, in particular, a range in which the metal member 6 supports the mold member 5 with respect to the vicinity of an end will be described. By expanding this range in a direction of the end, it is possible to form a concavoconvex shape in a wider range in the axial direction of the electrophotographic photosensitive member 1.

In order to further expand the range in which the metal member 6 supports the mold member 5 in the end direction, the following is important. That is, the electrophotographic photosensitive member 1, the mold member 5, the metal member 6, and the elastic member 7 are arranged so that an end of a range where the elastic member 7 and the metal member 6 are in contact with each other in the axial direction of the electrophotographic photosensitive member is outside the end of the electrophotographic photosensitive member. An example of such arrangement will be described with reference to FIG. 14A.

Figure 14A:
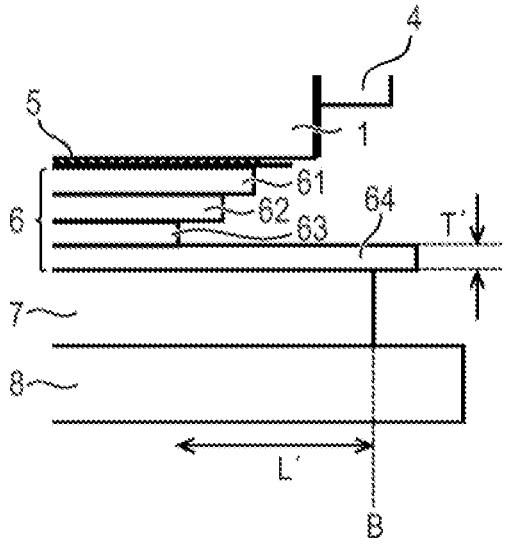
FIGS. 14A and 14B are diagrams showing an example of the method of forming the concave portion on the surface of the electrophotographic photosensitive member according to the present disclosure.
Figure 14B:
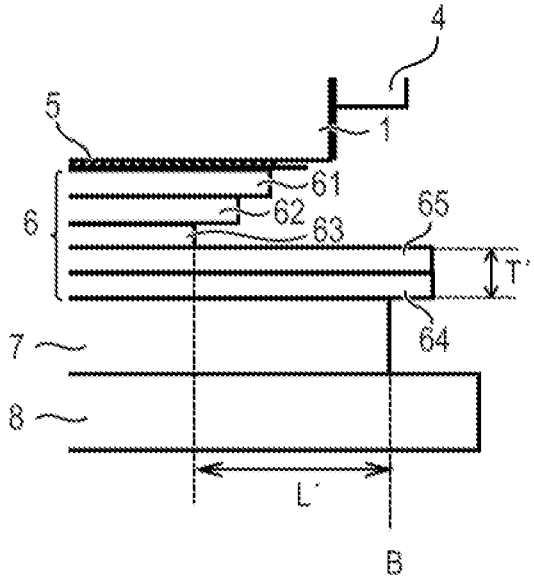

The metal member 6 shown in FIG. 14A has a first metal member 61, a second metal member 62, a third metal member 63, and a fourth metal member 64, and the elastic member 7 is in contact with the fourth metal member 64. In the axial direction of the electrophotographic photosensitive member 1, in a portion inside a boundary (position indicated by B in FIGS. 14A and 14B) of a range in which an end of the elastic member 7 supports the fourth metal member 64, the elastic member 7 receives the load force and generates stress. However, since there is no elastic member 7 in a portion outside the position indicated by B, the stress is not generated. Therefore, since the position of B is outside the end of the electrophotographic photosensitive member 1, stress against the load force can be obtained according to a range in which the first metal member 61 and the mold member 5 are in contact with each other. As shown in FIG. 14B, the metal member 6 may further have, between the third metal member 63 and the fourth metal member 64, a fifth metal member 65 in which a terminal position in the axial direction of the electrophotographic photosensitive member 1 is the same as that of the fourth metal member 64. A single fifth metal member 65 may be provided as shown in FIG. 14B, or the fifth metal member 65 may be composed of members.

Among the members of the metal member 6, a distance between a terminal position of the member having a terminal closest to the center in the axial direction of the electrophotographic photosensitive member 1, the third metal member 63 in the example shown in FIG. 14A, and a terminal position of the fourth metal member 64 in contact with the elastic member 7 is L'. On the other hand, a distance from the member having a terminal closest to the center in the axial direction of the electrophotographic photosensitive member 1, that is, the third metal member 63 in the example shown in FIG. 14A to the elastic member 7 is T'. At this time, it is preferable that L' and T' satisfy a relationship shown by the following formula 1.

$$3T' \leq L' \leq 20T' \quad \text{(Formula 1)}$$

Subsequently, a temperature of the mold member when the electrophotographic photosensitive member is pressed against the mold member to form a concavoconvex shape will be described.

In order to form a concavoconvex shape on the surface layer of the electrophotographic photosensitive member which is a resin, it is important to heat the mold member when the electrophotographic photosensitive member is pressed against the mold member. By heating the mold member, heat of the mold member is transferred to the surface layer of the electrophotographic photosensitive member when the electrophotographic photosensitive member is pressed, and the surface layer is softened to efficiently perform transfer. In addition, the temperature of the surface layer is lowered with time after the surface layer is spaced apart from the mold member, so that deformation of the surface layer can be fixed.

By preventing the temperature of the mold member from being partially biased, a degree of softening of the surface layer and a state of fixing the shape are not biased when the electrophotographic photosensitive member is pressed, and a uniform shape can be formed on the entire surface layer.

As described above, uniformity of a surface temperature of the mold member is important for ensuring uniformity of shape formation. An effective method for ensuring the uniformity of the surface temperature of the mold member will be described below.

A mold unit can be used as one of methods of efficiently positioning the mold member when the electrophotographic photosensitive member is pressed against the mold member as described above. This mold unit is constituted of a support member having a heating unit, an annular member, a buffer member, and the mold member, and the support member and the mold member are indirectly in contact with each other via the annular member to form a decompressable space. Then, by decompressing the decompressable space using a suction pump, adhesion of the support member, the buffer member, and the mold member is improved by a differential pressure from atmospheric pressure, and heat from a heat source of the support member can be efficiently transferred to the mold member.

Figure 15A:
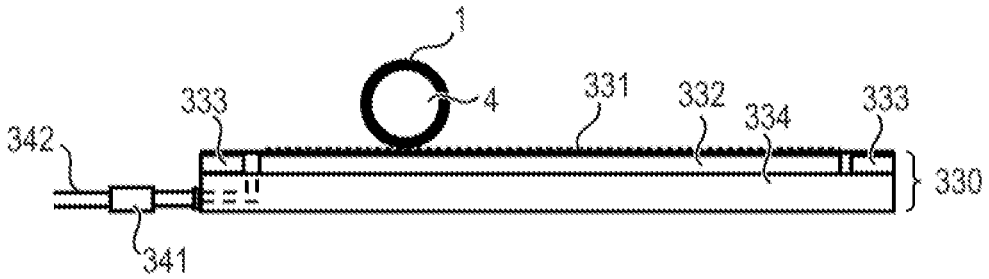
FIGS. 15A, 15B and 15C are diagrams showing an example of the method of forming the concave portion on the surface of the electrophotographic photosensitive member according to the present disclosure.
Figure 15B:
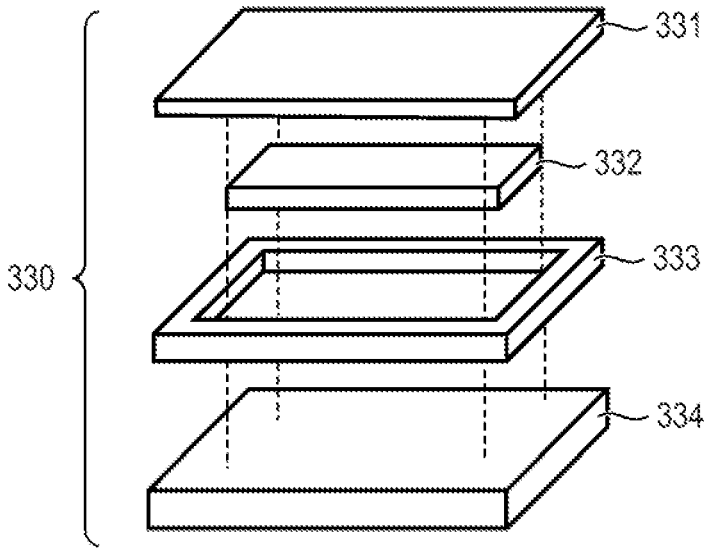
Figure 15C:
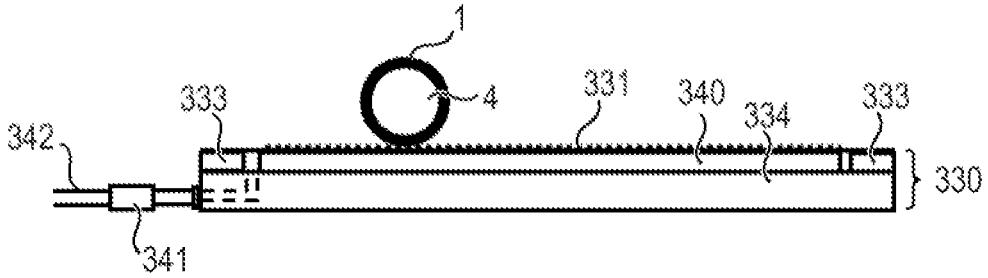

FIGS. 15A to 15C are diagrams showing a schematic configuration of the mold unit that can be suitably applied to a method of forming a concavoconvex shape on the surface of an electrophotographic photosensitive member.

The electrophotographic photosensitive member 1 has a cylindrical shape, and is supported in a state where the cylindrical insertion member 4 is inserted through the central portion thereof. A mold unit 330 is flat and has a mold member 331 having a concavoconvex shape on a surface facing the electrophotographic photosensitive member 1, an elastic member 332, an annular member 333, and a positioning member 334. The positioning member 334 has a heat source such as a heater and a circulation mechanism of a heat medium, and can supply heat to the mold member 331.

FIG. 15C shows the mold unit 330 without the elastic member 332 to illustrate a decompressable space 340. The mold member 331 and the positioning member 334 are indirectly in contact with each other via the annular member 333 to form the decompressable space 340.

The elastic member 332 is arranged inside the annular member 333 so as to be in contact with the mold member 331 and the positioning member 334. In addition, the decompressable space 340 is decompressed by using a suction pump (not shown), so that the pressure becomes the negative pressure with respect to the atmospheric pressure. Thus, adhesion of the positioning member 334, the elastic member 332, and the mold member 331 is improved by the differential pressure from the atmospheric pressure, and heat from a heat source of the positioning member 334 can be efficiently transferred to the mold member 331.

In order to maintain the adhesion of the positioning member 334, the elastic member 332, and the mold member 331, it is important to maintain the decompressed state of the decompressable space 340. When the mold member 331 is a relatively thin plate-shaped member, it may be difficult to maintain the decompressed state due to deformation of the electrophotographic photosensitive member 1 due to pressure contact. Therefore, for the purpose of reinforcing the mold member 331, a metal member may be arranged on a back surface of the mold member 331.

Figure 16:
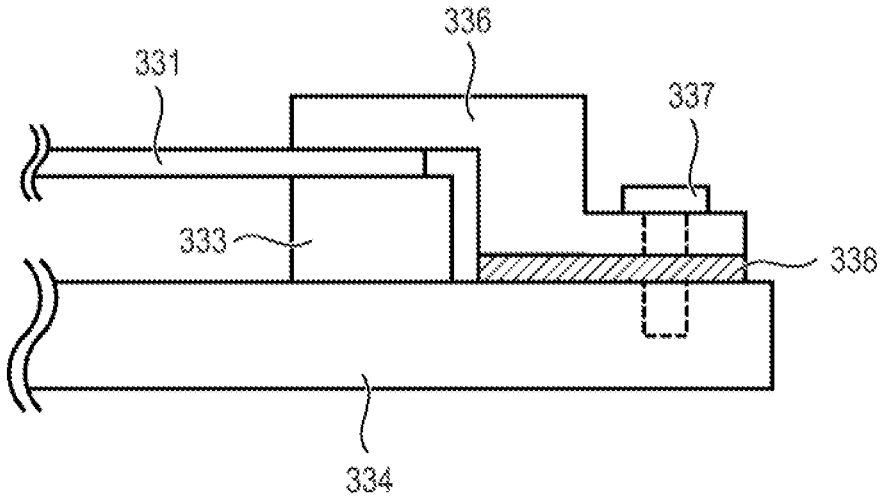
FIG. 16 is a diagram showing an example of the method of forming the concave portion on the surface of the electrophotographic photosensitive member according to the present disclosure.

FIG. 16 is a schematic view for explaining a schematic configuration of the mold unit that is suitably applicable to the method of forming a concavoconvex shape on the surface of the electrophotographic photosensitive member, and is a diagram shown by enlarging an end region of FIG. 15A.

As described above, the mold member 331 and the positioning member 334 are indirectly in contact with each other via the annular member 333, and the mold member 331 is integrally held with the positioning member 334 by a mold holding member 336 and a fixing member 337. Then, as shown in FIG. 16, a heat insulating material 338 is arranged between the mold holding member 336 and the positioning member 334.

By arranging the heat insulating material 338, the mold holding member 336 is thermally separated from the positioning member 334, and an amount of heat transferred to the mold holding member 336 from the heat source that the positioning member 334 has or is in contact with is reduced. As a result, the amount of heat transferred from the mold holding member 336 to the mold member 331 can be reduced. That is, the mold holding member 336 is in contact with the mold member 331 in an end region of the mold member 331, and the amount of heat transferred from the mold holding member 336 to the end region of the mold member 331 can be reduced. As a result, the amount of heat transferred from the elastic member 332 in contact with the mold member 331 in a central region becomes dominant, and heating becomes possible, so that the mold member 331 can be heated more uniformly.

As the material of the heat insulating material 338, it is preferable to use a resin such as a polyetheretherketone (PEEK) material from the viewpoint of heat insulating property and durability.

Subsequently, transfer operation will be described.

A method of transferring the convex shape of the mold member to the surface of the electrophotographic photosensitive member is performed by the following steps.

(i) Step of pressing the surface of the electrophotographic photosensitive member against the mold member with a predetermined pressing force (ii) Step of transferring the concave shape of the mold member to the surface of the electrophotographic photosensitive member by moving the mold member while pressing the surface of the electrophotographic photosensitive member against the mold member with a predetermined pressing force.

(iii) Step of spacing the electrophotographic photosensitive member apart from the mold member A moving direction of the mold member is a y direction, and a direction in which the electrophotographic photosensitive member is pressed against the mold member is a z direction.

Here, when the movement of the mold member in the y direction is terminated when the step (ii) is completed and the movement in the z direction is started in that state, a minute step (transfer track) may remain on the surface of the electrophotographic photosensitive member. On the other hand, in the step (iii), when an average speed of the electrophotographic photosensitive member 1 in the z direction is relatively small with respect to an average speed of the mold member in the y direction when the electrophotographic photosensitive member is spaced apart from the mold member, generation of the transfer track can be suppressed.

Specifically, in the step (iii), when the average speed of the mold member in the y direction of the mold member is Vy3 and the average speed of the electrophotographic photosensitive member in the z direction is Vz3, Vy3 and Vz3 satisfy a relationship shown by the following formula 2, so that the generation of the transfer track can be suppressed.

$$Vz3/Vy3<0.5 \quad \text{(Formula 2)}$$

It is more preferable that Vz3 and Vy3 satisfy a relationship shown by the following formula 3.

$$Vz3/Vy3<0.25 \quad \text{(Formula 3)}$$

By pressing the electrophotographic photosensitive member 1 in a state where the mold member 5 is heated, the concavoconvex shape of the mold member 5 can be easily transferred to the electrophotographic photosensitive member 1. In this case, since the electrophotographic photosensitive member 1 is in a state of being easily deformed by heat, a large transfer track tends to remain. Thus, in order to minimize the effect of heat on the transfer track, it is ideal to shorten the time of the step (iii).

In order to shorten the time of the step (iii) while maintaining the relationship shown by the formula 2 between Vy3 and Vz3, it is preferable that the average speeds Vy2 and Vy3 of the mold member in the y direction in the step (ii) satisfy a relationship shown by the following formula 4:

$$Vy2 \leq Vy3 \quad \text{(Formula 4)}$$

It is preferable that all the steps from the step (i) to the step (iii) are performed without stopping the movement of the mold member in the y direction. As a result, it is possible to prevent the heat received by the electrophotographic photosensitive member from the mold member from being concentrated on a part of the electrophotographic photosensitive member in the circumferential direction, and it is possible to further suppress the generation of the transfer track.

<Configuration of Electrophotographic Photosensitive Member>

The cylindrical electrophotographic photosensitive member according to the present disclosure has a support and a photosensitive layer.

Examples of the photosensitive layer include a single layer type photosensitive layer containing a charge transporting substance and a charge generating substance in the same layer and a lamination type (function separation type) photosensitive layer separately having a charge generating layer containing the charge generating substance and a charge transporting layer containing the charge transporting sub stance.

From the viewpoint of electrophotographic characteristics, the photosensitive layer is preferably a laminate type photosensitive layer. In the laminate type photosensitive layer, the charge generating layer may also have a lamination constitution, and the charge transporting layer may also have the lamination constitution.

As the support, a support showing electroconductivity (electroconductive support) is preferable. Examples of a material for the support include metals (alloys) such as iron, copper, gold, silver, aluminum, zinc, titanium, lead, nickel, tin, antimony, indium, chromium, aluminum alloy and stainless steel. Further, it is also possible to use a metal-made support and a plastic-made support which include a coating film formed by vacuum vapor deposition using, for example, aluminum, aluminum ally or indium oxide-tin oxide alloy. Further, it is also possible to use a support constituted by plastic or paper impregnated with electroconductive particles such as carbon black, tin oxide particles, titanium oxide particles or silver particles, or a support made of an electroconductive binder resin.

A surface of the support may also be subjected to, for example, cutting (machining), surface roughening or alumite process for the purpose of suppression of an interference fringe due to scattering of the laser light.

Between the support and an undercoat layer described later or the photosensitive layer (charge generating layer, charge transporting layer), for the purpose of suppressing the interference fringe due to the scattering of the laser light and for coating damage on the support, an electroconductive layer may also be provided.

The electroconductive layer can be formed by applying an electroconductive layer coating liquid that is produced by subjecting electroconductive particles, a binder resin, and a solvent to a dispersion treatment so as to form a coating film and drying and/or curing the resulting coating film.

Examples of electroconductive particles used for the electroconductive layer include carbon black, acetylene black, particles of metal such as aluminum, nickel, iron, nichrome, copper, zinc, and silver, and particles of metal oxide such as zinc oxide, titanium oxide, tin oxide, antimony oxide, indium oxide, bismuth oxide, and ITO. Alternatively, indium oxide doped with tin or tin oxide doped with antimony or tantalum may be used.

Examples of solvents of the electroconductive layer coating liquid include ether-based solvents, alcohol-based solvents, ketone-based solvents, and aromatic hydrocarbon solvents. The film thickness of the electroconductive layer is preferably 0.1 μm to 50 μm, more preferably 0.5 μm to 40 μm, and further preferably 1 μm to 30 μm.

Examples of binder resins used for the electroconductive layer include polymers and copolymers of vinyl compounds such as styrene, vinyl acetate, vinyl chloride, acrylic acid esters, methacrylic acid esters, vinylidene fluoride, and trifluoroethylene, polyvinyl alcohol resins, polyvinyl acetal resins, polycarbonate resins, polyester resins, polysulfone resins, polyphenylene oxide resins, polyurethane resins, cellulose resins, phenol resins, melamine resins, silicon resins, epoxy resins, and isocyanate resins.

An undercoat layer (intermediate layer) may be provided between the support or the electroconductive layer and the photosensitive layer.

The undercoat layer can be formed by applying an undercoat layer coating liquid that is produced by dissolving a binder resin into a solvent so as to form a coating film and drying the resulting coating film.

Examples of binder resins used for the undercoat layer include polyvinyl alcohol resins, poly-N-vinylimidazoles, polyethylene oxide resins, ethyl cellulose, ethylene-acrylic acid copolymers, casein, polyamide resins, N-methoxymethylated 6 nylon resins, copolymer nylon resins, phenol resins, polyurethanes resins, epoxy resins, acrylic resins, melamine resins, and polyester resins.

The undercoat layer may further contain metal oxide particles. Examples thereof include particles containing titanium oxide, zinc oxide, tin oxide, zirconium oxide, and aluminum oxide. Metal oxide particles may also be metal oxide particles in which the surfaces of the metal oxide particles are treated with a surface treatment agent such as a silane coupling agent.

Examples of solvents used for the undercoat layer coating liquid include organic solvents such as alcohol-based solvents, sulfoxide-based solvents, ketone-based solvents, ether-based solvents, ester-based solvents, aliphatic halogenated hydrocarbon-based solvents, and aromatic compounds. The film thickness of the undercoat layer is preferably 0.05 μm to 30 μm, and more preferably 1 μm to 25 μm. The undercoat layer may further contain organic resin fine particles and a leveling agent.

Examples of the charge generation material used for the photosensitive layer include pyrylium, thiapyrylium dyes, phthalocyanine pigments, anthanthrone pigments, dibenzpyrenequinone pigments, pyranthrone pigments, azo pigments, indigo pigments, quinacridone faces, asymmetric quinocyanine pigments, and quinocyanine pigments. One type of those charge generating substances may be used alone, or two or more types of them may be used in combination.

Examples of the charge transporting substance used in the photosensitive layer include hydrazone compounds, N,N-dialkylaniline compounds, diphenylamine compounds, triphenylamine compounds, triphenylmethane compounds, pyrazoline compounds, stylyl compounds, and stilbene compounds.

When the photosensitive layer is the laminate type photosensitive layer, the charge generating layer can be formed by applying a charge generating layer coating liquid, obtained by dispersing the charge generating substance together with a binder resin and a solvent, to form a coating film and by drying the resulting coating film.

A mass ratio of the charge generating substance and the binder resin is preferably in a range of 1:0.3 to 1:4.

Examples of dispersion treatment methods include methods using a homogenizer, ultrasonic dispersion, a ball mill, a vibrating ball mill, a sand mill, an attritor, a roll mill and the like.

The charge transporting layer can be formed by applying a charge transporting layer coating liquid, produced by dissolving a charge transporting substance and a binder resin into a solvent, to form a coating film and by drying the resulting coating film.

Examples of binder resins used for the charge generating layer and the charge transporting layer include polymers of vinyl compounds, polyvinyl alcohols, polyvinyl acetals, polycarbonates, polyesters, polysulfones, polyphenylene oxides, polyurethanes, cellulose resins, phenol resins, melamine resins, silicon resins, and epoxy resins.

The film thickness of the charge generating layer is preferably 5 μm or less, and more preferably 0.1 μm to 2 μm.

The film thickness of the charge transporting layer is preferably 5 μm to 50 μm, and more preferably 10 μm to 35 μm.

A protection layer containing electroconductive particles or a charge transporting substance and a binder resin may be provided on the photosensitive layer (charge transporting layer in the case of the laminate type photosensitive layer). When the protection layer is provided, the protection layer is the surface layer, and when not provided, the photosensitive layer is the surface layer.

The protection layer may further contain an additive such as a lubricant. The resin (binder resin) itself of the protection layer may have electroconductivity and charge transportability, and in that case, the protection layer does not have to contain electroconductive particles or a charge transporting substance other than the resin. The binder resin of the protection layer may be a thermoplastic resin or a curable resin that is cured by heat, light, radiation (electron beam or the like) or the like.

The film thickness of the protection layer is preferably 0.1 μm to 30 μm, and more preferably 1 μm to 10 μm.

Additives may be added to the respective layers of the electrophotographic photosensitive member. Examples of the additives include: anti-degradation agents such as an antioxidant and a UV absorber; organic resin particles such as fluorine atom-containing resin particles and acrylic resin particles; and inorganic particles made of silica, titanium oxide, alumina, etc.

<Configuration of Process Cartridge and Electrophotographic Apparatus>

Figure 13:
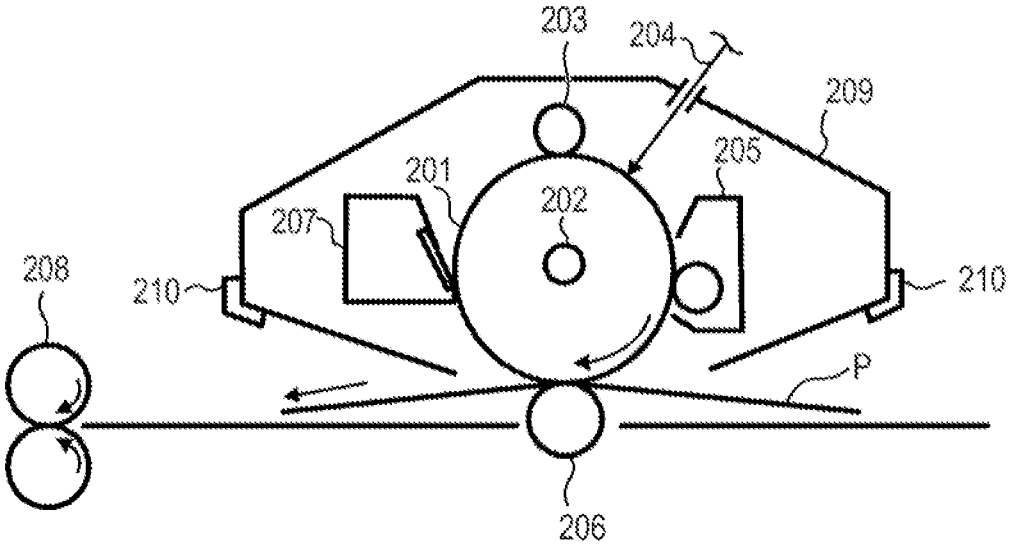
FIG. 13 is a diagram showing an example of an electrophotographic apparatus including a process cartridge having the electrophotographic photosensitive member according to the present disclosure.

FIG. 13 shows an example of an electrophotographic apparatus including a process cartridge having the electrophotographic photosensitive member according to the present disclosure.

In FIG. 13, a cylindrical electrophotographic photosensitive member 201 is rotationally driven about a shaft 202 in an arrow direction at a predetermined peripheral speed (process speed). The surface of the electrophotographic photosensitive member 201 is uniformly charged to a predetermined positive or negative potential by a charging unit 203 (primary charging unit: for example, charging roller) in the course of rotation. Next, the surface of the uniformly charged electrophotographic photosensitive member 201 receives exposure light (image exposure light) 204 emitted from an exposing unit (image exposing unit) (not shown). Thus, an electrostatic latent image corresponding to image information intended is formed on the surface of the electrophotographic photosensitive member 201.

In the present disclosure, in the case where the charging unit using electric discharge is used, a particularly large effect can be obtained.

The latent image formed on the surface of the electrophotographic photosensitive member 201 is then developed (normal development or reversal development) with a toner in a developing unit 205 so as to form a toner image. The toner image formed on the surface of the electrophotographic photosensitive member 201 is transferred onto a transfer material P by a transfer bias from a transfer unit (for example, a transfer roller) 206. At this time, the transfer material P is taken out and fed from a transfer material feeding unit (not shown) to between (contact portion) the electrophotographic photosensitive member 201 and the transfer unit 206 in synchronism with rotation of the electrophotographic photosensitive member 201. Further, to the transfer unit 206, a bias voltage of an opposite polarity to that of electric charges possessed by the toner is applied from a bias power source (not shown).

The transfer material P on which the toner image is transferred is separated from the surface of the electrophotographic photosensitive member 201 and fed to a fixing unit 208 to be subjected to toner image fixing, so that the transfer material P is printed out as an image-formed product (print, copy) to an outside of the electrophotographic apparatus.

The surface of the electrophotographic photosensitive member 201 after the toner image transfer is subjected to removal of a deposited matter such as a transfer residual toner by a cleaning unit 207 having a cleaning blade, and thus surface cleaned. The cleaning blade is disposed in contact with (contacted to) the surface of the electrophotographic photosensitive member 201 in almost the entire region in the axial direction of the electrophotographic photosensitive member 201. In addition, the cleaned surface of the electrophotographic photosensitive member 201 is charge-removed by pre-exposure light (not shown) from a pre-exposure unit (not shown), and thereafter is repetitively used for image formation. As shown in FIG. 13, when the charging unit 203 is a contact charging unit using a charging roller or the like, the pre-exposure unit is not necessarily required. In the present disclosure, the frictional force between the surface of the electrophotographic photosensitive member and the cleaning blade is reduced, so that wear of a tip of the cleaning blade is suppressed, and good cleaning characteristics can be maintained for a long period of time.

The process cartridge according to the present disclosure integrally supports the electrophotographic photosensitive member 201 and at least one unit selected from the group consisting of the charging unit 203, the developing unit 205, and the cleaning unit 207. The process cartridge can be detachably attachable to a main body of the electrophotographic apparatus such as a copier or a laser beam printer.

In FIG. 13, the electrophotographic photosensitive member 201, the charging unit 203, the developing unit 205, and the cleaning unit 207 are integrally supported to constitute a cartridge. A process cartridge 209 that is detachably attachable to the main body of the electrophotographic apparatus through a guide unit 210 such as rails of the main body of the electrophotographic apparatus is constituted.

The exposure light 204 is reflected light from an original manuscript or transmitted light when the electrophotographic apparatus is a copier or a printer. Alternatively, the exposure light 204 may be light irradiated by reading of the original manuscript by a sensor for conversion to signals, and scanning of a laser beam, driving of an LED array, driving of a liquid crystal shutter array, or the like performed according to the signals.

According to the present disclosure, it is possible to provide an electrophotographic photosensitive member that can suppress both a low-humidity durability streak and blade squealing.

EXAMPLE

Hereinafter, the present disclosure will be described in more detail using Examples and Comparative Examples. The present disclosure is not limited by Examples below unless departing from the gist of the disclosure. It is to be noted that in the description of Examples below, "Part" indicates a mass scale unless otherwise particularly stated. Moreover, hereinafter, the electrophotographic photosensitive member is also simply referred to as "photosensitive member".

(Production Example of Photosensitive Member 1)

<Support>

A cylindrical aluminum cylinder with a diameter of 29.9 mm, a length of 357.5 mm, and a thickness of 0.7 mm was used as the support.

<Undercoat Layer>

100 parts of zinc oxide particles (specific surface area: 19 $m^2/g$, powder resistance: $4.7\times10^6$ Ω·cm) as a metal oxide was stirred and mixed with 500 parts of toluene. Into this, 0.8 parts N-2-(aminoethyl)-3-aminopropylmethyldimethoxysilane (trade name: KBM 602, manufactured by Shin-Etsu Chemical Co., Ltd.) was added as a silane coupling agent, and was stirred 6 hours. Thereafter, toluene was distilled away under reduced pressure and was heated and dried at 140° C. for 6 hours, to obtain surface-treated zinc oxide particles.

Next, 15 parts of polyvinyl butyral (trade name: Eslek (registered trademark) B BM-1, manufactured by Sekisui Chemical Co., Ltd.) and 15 parts of blocked isocyanate (trade name: Sumidur 3175, manufactured by Sumitomo Bayer Urethane Co., Ltd.) were dissolved in a mixture solution. The mixed solution is a mixed solution of 73.5 parts of methyl ethyl ketone and 73.5 parts of 1-butanol.

In this solution, 80.8 parts of the surface-treated zinc oxide particles prepared above and 0.4 parts of 2,3,4-trihydroxybenzophenon (manufactured by Tokyo Chemical Industry Co., Ltd.) were added. Then, this was dispersed for 3 hours in an atmosphere of 23° C. in a sand mill device using glass beads with a diameter of 0.8 mm. After the dispersion, the following materials were added and stirred to prepare an undercoat layer coating liquid.

Silicone oil (trade name: SH28PA, manufactured by Dow Corning Toray Co., Ltd.): 0.01 parts Cross-linked polymethyl methacrylate (PMMA) particles (trade name: TECHPOLYMER (registered trademark) SSX-103, manufactured by Sekisui Chemical Co., Ltd. average primary particle size: 3.1 μm): 5.6 parts This undercoat layer coating liquid was dip-coated on the above-mentioned support, and a resultant coating film was dried for 40 minutes at 160° C., to form an undercoat layer having a film thickness of 18 μm.

<Charge Generating Layer>

The following four materials were placed in a sand mill using glass beads with a diameter of 1 mm and was dispersed for 4 hours, and thereafter 700 parts of ethyl acetate was added to prepare a charge generating layer coating liquid.

Hydroxygalium phthalocyanine crystal (charge generating substance) having crystal form having strong peaks at 7.4° and 28.2° in Bragg angles 2θ±0.2° in CuKα characteristic X-ray analysis: 20 parts Polyvinyl butyral (trade name: Eslek (registered trademark) B BX-1, manufactured by Sekisui Chemical Co., Ltd.): 10 parts Compound represented by the following formula (A): 0.2 parts Cyclohexanone: 600 parts This charge generating layer coating liquid was dip-coated on the undercoat layer, and a resultant coating film was dried for 15 minutes at 80° C., to form a charge generating layer having a film thickness of 0.18 μm.

(A)

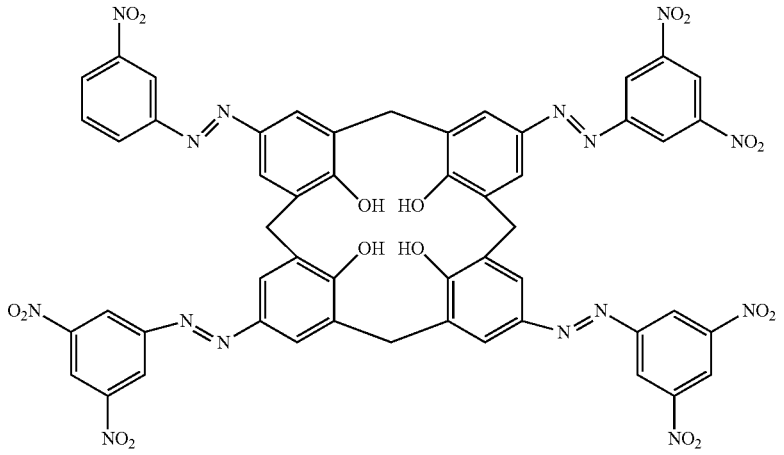

<Charge Transporting Layer>

Next, a charge transporting layer coating liquid was prepared.

The following materials were provided.

30 parts of compound represented by the following structural formula (B) (charge transporting substance)

60 parts of compound represented by the following structural formula (C) (charge transporting substance)

10 parts of compound represented by the following structural formula (D) (charge transporting substance)

100 parts of polycarbonate resin (trade name: Iupilon Z400, manufactured by Mitsubishi Engineering-Plastics Corp., bisphenol-Z-polycarbonate)

0.02 parts of polycarbonate (viscosity-average molecular weight Mv: 20000) represented by the following structural formula (E)

These substances were dissolved in a mixture solvent of 600 parts of mixed xylene and 200 parts of dimethoxy methane, whereby a charge transporting layer coating liquid was prepared. This charge transporting layer coating liquid was dip-coated on the charge generating layer to form a coating film, and the resultant coating film was dried for 30 minutes at 100° C., to form a charge transporting layer having a film thickness of 18 μm.

(B)

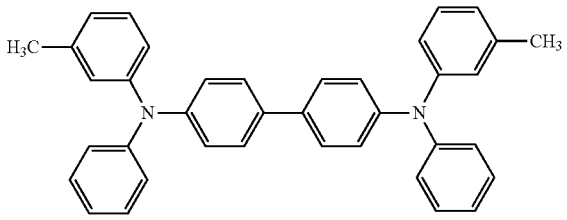

(C)

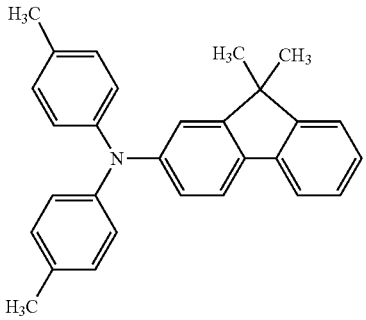

(D)

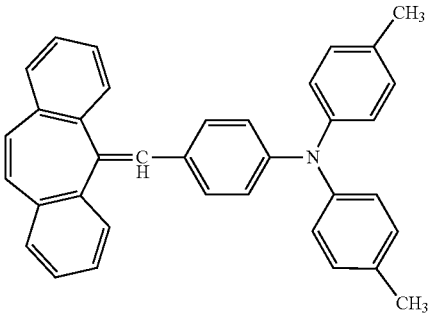

-continued (E)

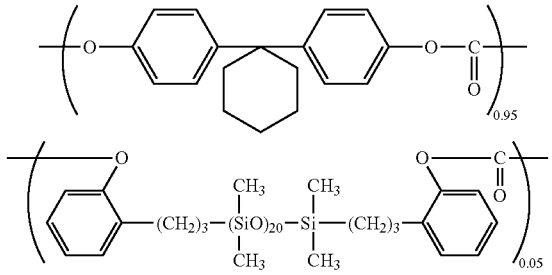

<Protection Layer>

Next, a mixture solvent of 20 parts of 1,1,2,2,3,3,4-heptafluorocyclopentane (trade name: ZEOROLA H, manufactured by Zeon Corp.)/20 parts of 1-propanol was filtered with polyflon filter (trade name: PF-040, manufactured by Advantec Toyo Kaisha, Ltd.). Thereafter, 90 parts of positive hole transporting compound (charge transporting substance) represented by the following structural formula (F), 70 parts of 1,1,2,2,3,3,4-heptafluorocyclopentane, and 70 parts of 1-propanol were added to the above-mentioned mixture solvent.

(F)

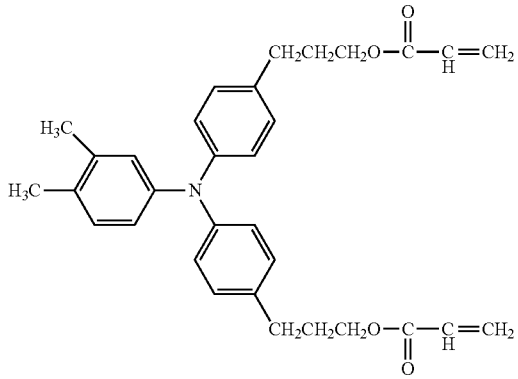

This mixture was filtered with the polyflon filter (trade name: PF-020, manufactured by Advantec Toyo Kaisha, Ltd.), whereby a protection layer coating liquid was prepared.

This protection layer coating liquid was dip-coated on the charge transporting layer, and a resultant coating film was dried for 6 minutes at 50° C. in ambient air. Thereafter, in a nitrogen atmosphere, while rotating the support (member to be irradiated) at 200 rpm, the coating film was irradiated with electron beam for 1.6 sec under a condition of acceleration voltage of 70 kV and absorbed dose of 8000 Gy. Subsequently, in a nitrogen atmosphere, the coating film was heated by increasing a temperature from 25° C. to 125° C. in 30 sec. Ambient oxygen concentration during the electron beam irradiation and subsequent heating was 15 ppm. Next, in the ambient air, heating treatment was performed for 30 minutes at 100° C. to form a protection layer having a film thickness of 5 μm cured by an electron beam.

In the coating films of all the layers applied in the production of the photosensitive member in Example, at the end of each application step, a lower end in a direction of pulling up the photosensitive member was peeled off using a solvent. Then, an application region of all the layers was set to a range from a place 1 mm away from an upper end of a cylindrical substrate in the direction of pulling up the photosensitive member to a place 1 mm away from a lower end of the cylindrical substrate.

Thus, a cylindrical electrophotographic photosensitive member before formation of the shape on the surface (photosensitive member before formation of the surface shape) was produced.

<Surface Processing>

By using the pressure contact profile transfer processing apparatus shown in FIGS. 8A to 8D, the surface shape was formed with respect to the photosensitive member before formation of the surface shape thus obtained.

First, the insertion member 4 was inserted into the electrophotographic photosensitive member 1 in a state of being preheated to 55° C. At the time of insertion, the insertion member 4 was inserted so that a center position in an axial core direction of the electrophotographic photosensitive member 1 coincides with a center position in an axial core direction of the insertion member 4. As the material of the insertion member, a cemented carbide mainly composed of tungsten carbide having a Young's modulus of $540\times10^3$ N/mm$^2$ was used.

The mold member 5, the metal member 6, the elastic member 7, and the positioning member 8 were arranged on the support member 9 in order from the member closest to the electrophotographic photosensitive member 1 to be transferred. The material of the support member 9 was SUS430, and a heater for heating was installed inside. The support member 9 is provided with a slide mechanism that moves in the Y direction shown in FIG. 8A. The positioning member 8 was used by performing electroless Ni plating on a surface of a plate made of SS400 having a thickness of 6 mm. Silicon rubber having a thickness of 8 mm was used for the elastic member 7. A flat plate made of SUS301CSP-3/4H having a thickness of 2 mm was used for the metal member 6.

Here, the mold member 5 used in Examples will be described with reference to FIGS. 9A and 9B. A flat plate mold made of nickel having a thickness of 300 μm was used for the mold member 5. On a surface of the mold member 5 in contact with the electrophotographic photosensitive member 1, the first convex-shaped portion 51 and the second convex-shaped portion 52 were provided at the positions shown in FIG. 9B, respectively. The mold member 5 was used while allocating the longitudinal direction in the figure to the axial direction of the electrophotographic photosensitive member, and a length 53 in the X direction including the first convex-shaped portion 51 and the second convex-shaped portion 52 was 345 mm. A length 54 in the Y direction of the convex-shaped portion in FIG. 9B was 100 mm. Widths 55 and 56 of the second convex-shaped portion from both ends in the X direction were 21 mm, respectively.

Figure 12A:
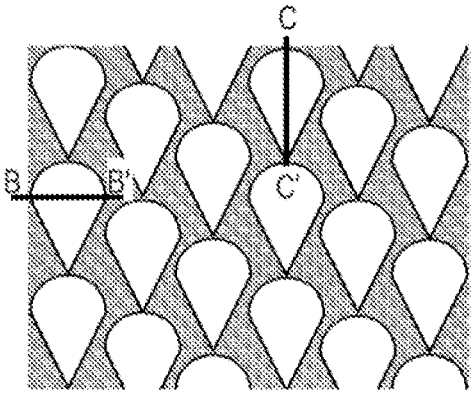
FIG. 12A is a schematic top view showing an example of the surface shape of the mold member.
Figure 12B:
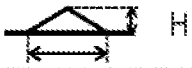
FIG. 12B is a schematic cross-sectional view of the mold member at a position B-B' in FIG. 12A, showing an example of the surface shape of the mold member.
Figure 12C:
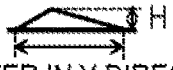
FIG. 12C is a schematic cross-sectional view of the mold member at a position C-C' in FIG. 12A, showing an example of the surface shape of the mold member.

In Example 1, the first convex-shaped portion 51 has a surface shape shown in FIGS. 12A to 12C. FIG. 12A is a schematic top view of the mold member, FIG. 12B is a schematic cross-sectional view of the mold member at a position B-B' in FIG. 12A, and FIG. 12C is a schematic cross-sectional view of the mold member at a position C-C' in FIG. 12A.

As shown in Table 1, the convex shape of the first convex-shaped portion 51 of the mold member 5 used in Example 1 has a diameter of 30 μm in the X direction, a diameter of 75 μm in the Y direction, an area ratio of 50%, and a height H of 1.6 μm.

In Example 1, the second convex-shaped portion 52 has a surface shape shown in FIGS. 11A to 11C. As shown in Table 1, the convex shape of the second convex-shaped portion 52 of the mold member 5 used in Example 1 has a diameter of 30 μm in the X direction, an area ratio of 98%, and a height H of 6.0 μm.

Here, the area ratio of the convex shape of the mold member 5 is a ratio of a total of an area of a region where the convex on the mold is provided to an area of a processed region of the mold member 5 on a plane when the mold member 5 is viewed from the upper surface. That is, the area ratio of the convex shape of the mold member 5 corresponds to the area ratio of the concave portion or groove to a surface area on the circumferential surface of the electrophotographic photosensitive member after the surface shape is formed.

This mold member 5 was used in the pressure contact profile transfer processing apparatus shown in FIG. 8A. The mold member 5 was fixed so that the left side shown in FIG. 9B was the left side shown in FIGS. 8A and 8B. Then, the temperature of the heater of the support member 9 was increased in a state where the heater was installed so that the upper surface was substantially horizontal, and the surface of the mold member 5 was heated to 150° C.

In order to press the surface of the electrophotographic photosensitive member 1 against the mold member 5, load mechanisms (not shown) are provided at both ends of the insertion member 4. Each load mechanism is provided with a guide rail and a ball screw in a vertical direction, and is further provided with a connection support member that is connected to the ball screw and the guide rail to move up and down. A servomotor was connected to a lower side of the ball screw and rotated, and the connection support member was moved up and down according to the guide rail. The connection support member and an end of the insertion member 4 were connected by a spherical joint. The spherical joint and the connection support member were connected via a load cell so that an amount of load applied to both ends of the insertion member 4 could be monitored.

In the processing of the electrophotographic photosensitive member 1, the electrophotographic photosensitive member 1 was pressed against the mold member 5 using the load mechanism, and the mold member 5 was moved by the slide mechanism in the Y direction shown in FIG. 8A. As a result, the shape of the mold member 5 was transferred to the surface of the electrophotographic photosensitive member 1 while rolling the electrophotographic photosensitive member 1.

During the processing, the position of the support member 9 was first adjusted so that a left end portion shown in FIGS. 9A and 9B of the convex-shaped portion of the mold member 5 was directly below the electrophotographic photosensitive member 1. Next, the servomotor of the load mechanism was rotated to move the insertion member 4 in the direction of the mold member 5 at a speed of 20 mm/sec (Vz1). Thereafter, the electrophotographic photosensitive member 1 came into contact with the mold member 5, and in addition, when it was detected by the load cell that the load applied to the insertion member 4 reached 6000 N, the movement of the load mechanism was stopped.

Next, the support member 9 was started to move in the Y direction of FIG. 8A at a speed of 10 mm/sec, and the electrophotographic photosensitive member 1 was subordinately rotated clockwise as shown in FIG. 8A. Thus, the convex-shaped portion on the surface of the mold member 5 was transferred to the surface of the electrophotographic photosensitive member 1. Then, while maintaining that state, the slide mechanism was stopped when moved by 95 mm, and then the insertion member 4 was moved in a direction of being spaced apart from the mold member 5 at a speed of 20 mm/sec by the load mechanism, and the electrophotographic photosensitive member 1 and the mold member 5 were spaced apart from each other.

Thus, the convex-shaped portion on the surface of the mold member 5 was transferred to the surface of the electrophotographic photosensitive member 1 while rolling the electrophotographic photosensitive member 1, so that the concave portion corresponding to the convex-shaped portion on the surface of the mold member 5 was formed on the surface of the electrophotographic photosensitive member 1.

By the above method, a cylindrical electrophotographic photosensitive member having a concave portion formed on the surface was produced, and the obtained electrophotographic photosensitive member was used as the photosensitive member 1.

<Observation of Electrophotographic Photosensitive Member Surface>

Subsequently, the following measurements were made on the concave portion formed on the surface of the obtained photosensitive member 1.

The surface of the electrophotographic photosensitive member 1 was observed through the laser microscope (manufactured by Keyence Corp., trade name: VK-9500) in an enlarged manner using a lens with a magnification of 50, so that the concave portion and the flat portion which were provided on the surface of the electrophotographic photosensitive member 1 as described above was determined.

During the observation, adjustment was made so that there was no inclination with respect to a longitudinal direction of the electrophotographic photosensitive member and so that the lens was focused on a vertex of the arc of the electrophotographic photosensitive member with respect to the circumferential direction. Then, information on the entire surface of the electrophotographic photosensitive member was obtained by connecting images observed in the enlarged manner with an image connecting application.

Further, an obtained result was subjected to filter processing with a filter type median by selecting image processing height data with an attached image analysis software.

By the above observation, each measurement was made on the concave portion and groove formed on the surface of the photosensitive member 1. The results are shown in Table 2.

A position in the axial direction of the photosensitive member 1 in the region A having the groove and a position in the axial direction of the photosensitive member 1 in the region B having the concave portion are shown in Table 2 so that the length of the surface layer in the axial direction of the photosensitive member 1 is 1, an end of the surface layer on an application upper end side is a 0-position, and an end of the surface layer on an application lower end side is a 1-position.

The surface of the photosensitive member 1 was observed in the same manner as that described above using another laser microscope (manufactured by Keyence Corp., trade name: X-9500). Also in this case, an effect similar to that in the case where the above-mentioned laser microscope (manufactured by Keyence Corp., trade name: X-100) was used was obtained. A laser microscope (manufactured by Keyence Corp., trade name: X-100) and a lens with a magnification of 50 were used to observe the surface of the photosensitive member (photosensitive members 2 to 22) produced in the following production examples.

(Production Examples of Photosensitive Members 2 to 22)

In the production example of the photosensitive member 1, the mold member 5 was changed to a mold member having a surface shape corresponding to the figure shown in Table 1 and having a convex shape having the dimensions shown in Table 1. Except for this, the photosensitive members 2 to 22 were produced in the same manner as in the production example of the photosensitive member 1. With respect to the photosensitive members 2 to 22, the surfaces of the obtained photosensitive members were observed and each measurement was made in the same manner as in the photosensitive member 1. The results are shown in Table 2.

(Actual Machine Evaluation of Electrophotographic Photosensitive Member)

Example 1

The photosensitive member 1 was mounted in a cyan station of a modified machine of an electrophotographic apparatus (multifunctional machine) (trade name: iR-ADV C5255, manufactured by Canon Inc.) which was an evaluation apparatus, and test and evaluation were made as follows.

The photosensitive member 1 was attached to a drum cartridge for an electrophotographic apparatus so that the upper end side in the pulling-up direction during the application of the photosensitive member 1 was a depth side of the modified machine of the electrophotographic apparatus iR-ADV C5255. The top of the convex portion of the photosensitive member 1 is located on the upstream side in a rotational direction of the photosensitive member 1.

As the cleaning blade, one attached to the drum cartridge for the electrophotographic apparatus (hardness: 80 JISA°, rebound resilience at 25° C.: 35%) was used as it was. An abutment angle (narrow angle) between the electrophotographic photosensitive member and a blade lower surface of the cleaning blade was set to 25°, and abutment pressure with the electrophotographic photosensitive member was set to 32 gf/cm.

A black toner was used for evaluation, and a toner having a weight average particle diameter of 4.0 μm was used.

In an environment of 23° C./5% RH, conditions of a charging device and an image exposure device were set so that a dark-portion potential (Vd) of the photosensitive member 1 was −800 V and a light-portion potential (Vl) was −300 V, and an initial potential of the photosensitive member 1 was adjusted. A heater (drum heater) for the electrophotographic photosensitive member was turned off.

In the environment of 23° C./5% RH, 100,000 sheets of images (chart for evaluation) of A4 (landscape orientation) in size and 1% in print ratio were continuously output. Thereafter, a halftone image (screen image) having a cyan density of 30% was output, and the low-humidity durability streak on the image was evaluated as follows. As for the evaluation rank, A is the best, and E is the worst. The evaluation results are shown in Table 2.

[Rank Evaluation Criteria for Low-Humidity Durability Streak]

A: There are no streaks on image.

B: Image on which streaks seemed to be present was obtained, but is at a level where it is impossible to determine whether it is obviously a streak.

C: Extremely slight streaks can be slightly observed on image, but the image is at a level where there is no problem.

D: There are slight streaks on image, but the image is at an acceptable level.

E: There are clear streaks on image. The image is at an unacceptable level.

Subsequently, the blade squealing was evaluated. A drum cartridge as in the low-humidity streak evaluation was used except that the abutment pressure of the cleaning blade with the photosensitive member 1 was changed to 40 gf/cm.

In an environment of 30° C./80% RH, conditions of a charging device and an image exposure device were set so that the dark-portion potential (Vd) of the electrophotographic photosensitive member was −500 V and the light-portion potential (Vl) was −180 V, and the initial potential of the photosensitive member 1 was adjusted.

In the environment of 30° C./80% RH, 800,000 sheets of images (chart for evaluation) of A4 in size and 1% in print ratio were continuously output. In this evaluation, A4 size evaluation paper was fed vertically (the short side of the paper was located perpendicular to a paper transport direction).

The squealing of the cleaning blade under evaluation was evaluated according to the following criteria. As for the evaluation rank, A is the best, and D is the worst. The evaluation results are shown in Table 2.

[Rank Evaluation Criteria for Blade Squealing]

A: Squealing of cleaning blade does not occur.

B: Squealing of cleaning blade seemed to occur, but is at a level where it is impossible to determine clearly.

C: Squealing of cleaning blade slightly occurs.

D: Squealing of cleaning blade clearly occurs.

Examples 2 to 20, Comparative Example 1 and Comparative Example 2

The actual machine evaluation of the photosensitive members 2 to 22 was carried out in the same manner as in Example 1 except that the photosensitive members shown in Table 2 were used as the electrophotographic photosensitive members. When the convex portion of the photosensitive member has a top, the top is located on the upstream side in the rotational direction of the photosensitive member in each Example and Comparative Example. The evaluation results are shown in Table 2.

TABLE 1

| | Mold member | | | | | | | | | |
|---|---|---|---|---|---|---|---|---|---|---|
| | Second convex-shaped portion | | | | | First convex-shaped portion | | | | |
| | Surface shape | Diameter in X direction (μm) | Diameter in Y direction (μm) | Area ratio (%) | Height H (μm) | Surface shape | Diameter in X direction (μm) | Diameter in Y direction (μm) | Area ratio (%) | Height H (μm) |
| Photosensitive member 1 | FIGS. 11A to 11C | 30 | — | 98 | 6 | FIGS. 12A to 12C | 30 | 75 | 50 | 1.6 |
| Photosensitive member 2 | FIGS. 11A to 11C | 2 | — | 98 | 6 | FIGS. 12A to 12C | 30 | 75 | 50 | 1.6 |
| Photosensitive member 3 | FIGS. 11A to 11C | 50 | — | 98 | 6 | FIGS. 12A to 12C | 30 | 75 | 50 | 1.6 |
| Photosensitive member 4 | FIGS. 11A to 11C | 30 | — | 98 | 0.6 | FIGS. 12A to 12C | 30 | 75 | 50 | 1.6 |
| Photosensitive member 5 | FIGS. 11A to 11C | 30 | — | 98 | 1.6 | FIGS. 12A to 12C | 30 | 75 | 50 | 1.6 |
| Photosensitive member 6 | FIGS. 11A to 11C | 30 | — | 98 | 3 | FIGS. 12A to 12C | 30 | 75 | 50 | 3 |
| Photosensitive member 7 | FIGS. 11A to 11C | 30 | — | 98 | 10 | FIGS. 12A to 12C | 30 | 75 | 50 | 1.6 |
| Photosensitive member 8 | FIGS. 11A to 11C | 30 | — | 65 | 6 | FIGS. 12A to 12C | 30 | 75 | 50 | 1.6 |
| Photosensitive member 9 | FIGS. 11A to 11C | 30 | — | 100 | 6 | FIGS. 12A to 12C | 30 | 75 | 50 | 1.6 |
| Photosensitive member 10 | FIGS. 11A to 11C | 30 | — | 98 | 6 | FIGS. 12A to 12C | 30 | 75 | 50 | 0.6 |
| Photosensitive member 11 | FIGS. 11A to 11C | 30 | — | 98 | 6 | FIGS. 12A to 12C | 30 | 75 | 50 | 3 |
| Photosensitive member 12 | FIGS. 11A to 11C | 30 | — | 98 | 6 | FIGS. 12A to 12C | 20 | 20 | 50 | 1.6 |
| Photosensitive member 13 | FIGS. 11A to 11C | 30 | — | 98 | 6 | FIGS. 12A to 12C | 30 | 200 | 50 | 1.6 |
| Photosensitive member 14 | FIGS. 11A to 11C | 30 | — | 98 | 6 | FIGS. 12A to 12C | 20 | 75 | 50 | 1.6 |
| Photosensitive member 15 | FIGS. 11A to 11C | 30 | — | 98 | 6 | FIGS. 12A to 12C | 200 | 200 | 50 | 1.6 |
| Photosensitive member 16 | FIGS. 11A to 11C | 50 | — | 98 | 6 | FIGS. 12A to 12C | 30 | 75 | 50 | 3 |
| Photosensitive member 17 | FIGS. 11A to 11C | 30 | — | 98 | 6 | FIGS. 10A, 10B | 50 | 50 | 5 | 1.6 |
| Photosensitive member 18 | FIGS. 11A to 11C | 30 | — | 98 | 6 | FIGS. 10A, 10B | 50 | 50 | 65 | 1.6 |
| Photosensitive member 19 | FIGS. 11A to 11C | 30 | — | 98 | 6 | FIGS. 10A, 10B | 50 | 50 | 50 | 1.6 |
| Photosensitive member 20 | FIGS. 11A to 11C | 40 | — | 98 | 2 | FIGS. 10A, 10B | 50 | 50 | 50 | 2.4 |
| Photosensitive member 21 | FIGS. 10A, 10B | 50 | 50 | 50 | 1.6 | FIGS. 10A, 10B | 50 | 50 | 50 | 1.6 |
| Photosensitive member 22 | FIGS. 11A to 11C | 30 | — | 98 | 6 | FIGS. 11Ato 11C | 30 | — | 98 | 6 |

TABLE 2

| | | Surface of region A of photosensitive member | | | | Surface of region B of photosensitive member | | | | | Evaluation result | |
|---|---|---|---|---|---|---|---|---|---|---|---|---|
| | Photo-sensitive member | Groove width W1 (μm) | Groove depth d1 (μm) | Groove area ratio a1 (%) | Axial position | Concave depth d2 (μm) | Axial width W2 of concave (μm) | Circum-ferential width L1 of concave (μm) | Concave area ratio a2 (%) | Axial position | Streak | Blade squeal-ing |
| Example 1 | Photo-sensitive member 1 | 30 | 3 | 98 | 0.02 to 0.08, 0.92 to 0.98 | 0.8 | 30 | 75 | 50 | 0.08 to 0.92 | A | A |
| Example 2 | Photo-sensitive member 2 | 2 | 3 | 98 | 0.02 to 0.08, 0.92 to 0.98 | 0.8 | 30 | 75 | 50 | 0.08 to 0.92 | A | A |
| Example 3 | Photo-sensitive member 3 | 50 | 3 | 98 | 0.02 to 0.08, 0.92 to 0.98 | 0.8 | 30 | 75 | 50 | 0.08 to 0.92 | A | B |
| Example 4 | Photo-sensitive member 4 | 30 | 0.3 | 98 | 0.02 to 0.08, 0.92 to 0.98 | 0.8 | 30 | 75 | 50 | 0.08 to 0.92 | A | B |
| Example 5 | Photo-sensitive member 5 | 30 | 0.8 | 98 | 0.04 to 0.08, 0.92 to 0.96 | 0.8 | 30 | 75 | 50 | 0.08 to 0.92 | A | A |
| Example 6 | Photo-sensitive member 6 | 30 | 1.5 | 98 | 0.02 to 0.08, 0.92 to 0.98 | 1.5 | 30 | 75 | 50 | 0.08 to 0.92 | A | A |
| Example 7 | Photo-sensitive member 7 | 30 | 5 | 98 | 0.02 to 0.08, 0.92 to 0.98 | 0.8 | 30 | 75 | 50 | 0.08 to 0.92 | A | A |
| Example 8 | Photo-sensitive member 8 | 30 | 3 | 65 | 0.02 to 0.08, 0.92 to 0.98 | 0.8 | 30 | 75 | 50 | 0.08 to 0.92 | A | A |
| Example 9 | Photo-sensitive member 9 | 30 | 3 | 100 | 0.02 to 0.08, 0.92 to 0.98 | 0.8 | 30 | 75 | 50 | 0.08 to 0.92 | A | A |
| Example 10 | Photo-sensitive member 10 | 30 | 3 | 98 | 0.02 to 0.08, 0.92 to 0.98 | 0.3 | 30 | 75 | 50 | 0.08 to 0.92 | A | A |
| Example 11 | Photo-sensitive member 11 | 30 | 3 | 98 | 0.02 to 0.08, 0.92 to 0.98 | 1.5 | 30 | 75 | 50 | 0.08 to 0.92 | A | A |
| Example 12 | Photo-sensitive member 12 | 30 | 3 | 98 | 0.02 to 0.08, 0.92 to 0.98 | 0.8 | 20 | 20 | 50 | 0.08 to 0.92 | A | B |
| Example 13 | Photo-sensitive member 13 | 30 | 3 | 98 | 0.02 to 0.08, 0.92 to 0.98 | 0.8 | 30 | 200 | 50 | 0.08 to 0.92 | A | A |
| Example 14 | Photo-sensitive member 14 | 30 | 3 | 98 | 0.02 to 0.08, 0.92 to 0.98 | 0.8 | 20 | 75 | 50 | 0.08 to 0.92 | A | B |
| Example 15 | Photo-sensitive member 15 | 30 | 3 | 98 | 0.02 to 0.08, 0.92 to 0.98 | 0.8 | 200 | 200 | 50 | 0.08 to 0.92 | A | A |
| Example 16 | Photo-sensitive member 16 | 50 | 0.8 | 98 | 0.02 to 0.08, 0.92 to 0.98 | 1.5 | 30 | 75 | 50 | 0.08 to 0.92 | A | C |
| Example 17 | Photo-sensitive member 17 | 30 | 3 | 98 | 0.02 to 0.08, 0.92 to 0.98 | 0.8 | 50 | 50 | 5 | 0.08 to 0.92 | B | A |
| Example 18 | Photo-sensitive member 18 | 30 | 3 | 98 | 0.02 to 0.08, 0.92 to 0.98 | 0.8 | 50 | 50 | 65 | 0.08 to 0.92 | B | A |
| Example 19 | Photo-sensitive member 19 | 30 | 3 | 98 | 0.02 to 0.08, 0.92 to 0.98 | 0.8 | 50 | 50 | 50 | 0.08 to 0.92 | B | A |
| Example 20 | Photo-sensitive member 20 | 40 | 1 | 98 | 0.02 to 0.08, 0.92 to 0.98 | 1.2 | 50 | 50 | 50 | 0.08 to 0.92 | B | C |
| Comparative Example 1 | Photo-sensitive member 21 | — | — | — | — | 0.8 | 50 | 50 | 50 | 0.02 to 0.98 | A | D |
| Comparative Example 2 | Photo-sensitive member 22 | 30 | 3 | 98 | 0.02 to 0.98 | — | — | — | — | — | E | A |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-56463, filed Mar. 26, 2020, which is hereby incorporated by reference herein in its entirety

What is claimed is:

1. A cylindrical electrophotographic photosensitive member having a support and a surface layer, comprising:

a region A along an outer surface of the surface layer; and a region B along the outer surface of the surface layer, wherein the region A is located on an end side in an axial direction of the electrophotographic photosensitive member relative to the region B, the region A has a groove provided on the outer surface of the electrophotographic photosensitive member, an average value d1 of a depth of the groove is 0.3 μm to 5.0 μm, a width of the groove in a circumferential direction of the electrophotographic photosensitive member is 500 μm or more, an average value W1 of the width of the groove in the axial direction of the electrophotographic photosensitive member is 2 μm to 50 μm, an area ratio a1 of the groove is 65% to 100%, the region B has concave portions provided on the outer surface of the electrophotographic photosensitive member, an average value d2 of a depth of the concave portion is 0.3 μm to 1.5 μm, an average value L1 of a width of the concave portion in the circumferential direction of the electrophotographic photosensitive member is 20 μm to 200 μm, an average value W2 of the width of the concave portion in the axial direction of the electrophotographic photosensitive member is equal to or less than the L1, an area ratio a2 of the concave portion is 5% to 65%, and the area ratio a1 of the groove is larger than the area ratio a2 of the concave portion.

2. The electrophotographic photosensitive member according to claim 1, wherein when a length of the surface layer in the axial direction of the electrophotographic photosensitive member is 1, and a position in the axial direction of the electrophotographic photosensitive member is expressed by a value of 0 to 1, the region A is within at least one of a range of 0 to 0.08 and a range of 0.92 to 1.

3. The electrophotographic photosensitive member according to claim 1, wherein the average value W2 of the width of the concave portion in the axial direction of the electrophotographic photosensitive member is equal to or more than the average value W1 of the width of the groove in the axial direction of the electrophotographic photosensitive member.

4. The electrophotographic photosensitive member according to claim 1, wherein the average value d1 of the depth of the groove is equal to or more than the average value d2 of the depth of the concave portion.

5. The electrophotographic photosensitive member according to claim 1, wherein a contour of an opening of the concave portion has a top on an upstream side in a rotational direction of the electrophotographic photosensitive member, an angle α of the top is more than 0° and 90° or less, in the contour of the opening of the concave portion, a width of the contour of the opening of the concave portion in the axial direction of the electrophotographic photosensitive member is reduced from a portion in which the width of the contour of the opening of the concave portion in the axial direction of the electrophotographic photosensitive member is maximum to the top, and in a cross section of the concave portion perpendicular to the axial direction of the electrophotographic photosensitive member and including the top, the concave portion becomes shallow from a deepest point of the concave portion in the cross section to the top.

6. The electrophotographic photosensitive member according to claim 1, wherein the region A has the grooves, and the grooves are arranged independently of each other in the axial direction of the electrophotographic photosensitive member.

7. A process cartridge integrally supporting a cylindrical electrophotographic photosensitive member and at least one unit selected from the group consisting of a charging unit, a developing unit, and a cleaning unit, and being detachably attachable to a main body of an electrophotographic apparatus, the electrophotographic photosensitive member having a support and a surface layer, and having a region A along an outer surface of the surface layer and a region B along the outer surface of the surface layer, the region A being located on an end side in an axial direction of the electrophotographic photosensitive member relative to the region B, the region A having a groove provided on the outer surface of the electrophotographic photosensitive member, an average value d1 of a depth of the groove being 0.3 μm to 5.0 μm, a width of the groove in a circumferential direction of the electrophotographic photosensitive member being 500 μm or more, an average value W1 of the width of the groove in the axial direction of the electrophotographic photosensitive member being 2 μm to 50 μm, an area ratio a1 of the groove being 65% to 100%, the region B having concave portions provided on the outer surface of the electrophotographic photosensitive member, an average value d2 of a depth of the concave portion being 0.3 μm to 1.5 μm, an average value L1 of a width of the concave portion in the circumferential direction of the electrophotographic photosensitive member being 20 μm to 200 μm, an average value W2 of the width of the concave portion in the axial direction of the electrophotographic photosensitive member being equal to or less than the L1, an area ratio a2 of the concave portion being 5% to 65%, and the area ratio a1 of the groove being larger than the area ratio a2 of the concave portion.

8. An electrophotographic apparatus comprising a cylindrical electrophotographic photosensitive member, a charging unit, an exposing unit, a developing unit, a transfer unit, and a cleaning unit, in an axial direction of the electrophotographic photosensitive member, an end of an image-formable region of the electrophotographic photosensitive member being within a range of the region B, the electrophotographic photosensitive member having a support and a surface layer, and having a region A along an outer surface of the surface layer and a region B along the outer surface of the surface layer, the region A being located on an end side in an axial direction of the electrophotographic photosensitive member relative to the region B, the region A having a groove provided on the outer surface of the electrophotographic photosensitive member, an average value d1 of a depth of the groove being 0.3 μm to 5.0 μm, a width of the groove in a circumferential direction of the electrophotographic photosensitive member being 500 μm or more, an average value W1 of the width of the groove in the axial direction of the electrophotographic photosensitive member being 2 μm to 50 μm, an area ratio a1 of the groove being 65% to 100%, the region B having concave portions provided on the outer surface of the electrophotographic photosensitive member, an average value d2 of a depth of the concave portion being 0.3 μm to 1.5 μm, an average value L1 of a width of the concave portion in the circumferential direction of the electrophotographic photosensitive member being 20 μm to 200 μm, an average value W2 of the width of the concave portion in the axial direction of the electrophotographic photosensitive member being equal to or less than the L1, an area ratio a2 of the concave portion being 5% to 65%, and the area ratio a1 of the groove being larger than the area ratio a2 of the concave portion.

* * * * *